US007458853B2

(12) United States Patent
Omura et al.

(10) Patent No.: US 7,458,853 B2
(45) Date of Patent: Dec. 2, 2008

(54) CONNECTOR DEVICE HAVING A GROUND SHIELD DEVICE

(75) Inventors: Kimihiko Omura, Shinagawa (JP); Tadashi Kumamoto, Shinagawa (JP); Hideo Miyazawa, Shinagawa (JP)

(73) Assignee: Fujitsu Component Limited, Tokyo (JP)

( * ) Notice: Subject to any disclaimer, the term of this patent is extended or adjusted under 35 U.S.C. 154(b) by 0 days.

(21) Appl. No.: 11/892,138

(22) Filed: Aug. 20, 2007

(65) Prior Publication Data

US 2008/0242148 A1 Oct. 2, 2008

(30) Foreign Application Priority Data

Mar. 29, 2007 (JP) ..... 2007-088779

(51) Int. Cl.
*H01R 13/648* (2006.01)

(52) U.S. Cl. ..... 439/607; 439/660

(58) Field of Classification Search ..... 439/607, 439/578, 63, 660, 668, 669, 101, 108
See application file for complete search history.

(56) References Cited

U.S. PATENT DOCUMENTS

| | | | | |
|---|---|---|---|---|
| 4,681,385 | A * | 7/1987 | Kruger et al. | 439/252 |
| 5,915,995 | A * | 6/1999 | Meyer et al. | 439/668 |
| 6,623,277 | B1 * | 9/2003 | Zhu et al. | 439/63 |
| 6,634,896 | B1 * | 10/2003 | Potega | 439/218 |
| 6,869,316 | B2 * | 3/2005 | Hinkle et al. | 439/675 |
| 6,932,614 | B1 * | 8/2005 | Kan | 439/580 |
| 6,945,796 | B2 * | 9/2005 | Bassler et al. | 439/101 |
| 7,086,867 | B2 * | 8/2006 | Nakagawa et al. | 439/63 |
| 2004/0152363 | A1 * | 8/2004 | Ozai et al. | 439/660 |

FOREIGN PATENT DOCUMENTS

| | | |
|---|---|---|
| JP | 11-067372 | 3/1999 |

* cited by examiner

*Primary Examiner*—Michael C Zarroli
(74) *Attorney, Agent, or Firm*—Staas & Halsey LLP

(57) ABSTRACT

A disclosed plug connector is configured to be plugged into and connected to a receiving connector. The plug connector includes plural signal contact members arranged along a circumferential direction, and a cylindrical ground unit surrounding an outer peripheral side of the signal contact members.

18 Claims, 27 Drawing Sheets

CONNECTOR DEVICE HAVING A GROUND SHIELD DEVICE

BACKGROUND OF THE INVENTION

1. Field of the Invention

The present invention relates to a connector device, and more particularly to a connector device including a receiving connector and a plug connector.

2. Description of the Related Art

Generally, in connector devices including a receiving connector and a plug connector, signal contacts are horizontally aligned in a straight line. There are also connector devices including a receiving connector and a plug connector that have a cylindrical overall shape. In such cylindrical connector devices, signal contacts are arranged in a circumferential direction.

Japanese Laid-Open Patent Application No. H11-67372

However, conventional cylindrical connector devices do not sufficiently address the problems of electromagnetic noise from the outside or crosstalk occurring in a single connector.

SUMMARY OF THE INVENTION

The present invention provides a connector device in which one or more of the above-described disadvantages are eliminated.

An embodiment of the present invention provides a plug connector configured to be plugged into and connected to a receiving connector, the plug connector including plural signal contact members arranged along a circumferential direction; and a cylindrical ground unit surrounding an outer peripheral side of the signal contact members.

An embodiment of the present invention provides a plug connector configured to be plugged into and connected to a receiving connector, the plug connector including plural signal contact members arranged along a circumferential direction; and a cylindrical ground unit arranged on an inner peripheral side of the signal contact members.

An embodiment of the present invention provides a receiving connector into which a plug connector is plugged, wherein the plug connector includes plural signal contact members arranged along a circumferential direction and a cylindrical ground unit surrounding an outer peripheral side of the signal contact members, the receiving connector including plural ground contact pieces arranged along the circumferential direction in such a manner as to contact the cylindrical ground unit of the plug connector; and plural signal contact pieces arranged along the circumferential direction in such a manner as to contact the signal contact members of the plug connector.

An embodiment of the present invention provides a receiving connector into which a plug connector is plugged, wherein the plug connector includes plural signal contact members arranged along a circumferential direction, one or more ground contact members each arranged between adjacent said signal contact members, and a cylindrical ground unit surrounding an outer peripheral side of the signal contact members and the ground contact members, the receiving connector including plural signal contact pieces arranged along the circumferential direction in such a manner as to contact the signal contact members of the plug connector; and plural ground contact pieces arranged along the circumferential direction in such a manner as to contact the cylindrical ground unit and the ground contact members of the plug connector.

An embodiment of the present invention provides a receiving connector into which a plug connector is plugged, wherein the plug connector includes plural signal contact members arranged along a circumferential direction and a cylindrical ground unit arranged on an inner peripheral side of the signal contact members, the receiving connector including plural ground contact pieces arranged along the circumferential direction in such a manner as to contact the cylindrical ground unit of the plug connector; and plural signal contact pieces arranged along the circumferential direction in such a manner as to contact the signal contact members of the plug connector.

An embodiment of the present invention provides a receiving connector into which a plug connector is plugged, wherein the plug connector includes plural signal contact members arranged along a circumferential direction, one or more ground contact members each arranged between adjacent said signal contact members, and a cylindrical ground unit arranged on an inner peripheral side of the signal contact members and the ground contact members, the receiving connector including plural signal contact pieces arranged along the circumferential direction in such a manner as to contact the signal contact members of the plug connector; and plural ground contact pieces arranged along the circumferential direction in such a manner as to contact the cylindrical ground unit and the ground contact members of the plug connector.

According to one embodiment of the present invention, a connector device is highly resistant to electromagnetic noise from the outside.

BRIEF DESCRIPTION OF THE DRAWINGS

Other objects, features and advantages of the present invention will become more apparent from the following detailed description when read in conjunction with the accompanying drawings, in which:

FIGS. 3A through 3D illustrate the receiving connector and the cylindrical plug connector corresponding to each other according to the first embodiment of the present invention, in which FIG. 3C is a cross-sectional view taken along line C-C of FIG. 3D;

FIGS. 4A, 4B illustrate a status where the plug connector is connected to the receiving connector according to the first embodiment of the present invention, in which FIG. 4B is a cross-sectional view taken along line B-B of FIG. 4A;

FIGS. 7A, 7B illustrate the receiving connector of the connector device according to the second embodiment of the present invention, in which FIG. 7A is a cross-sectional view taken along line A-A of FIG. 7B;

FIGS. 13A through 13D illustrate the receiving connector and the cylindrical plug connector corresponding to each other according to the fourth embodiment of the present invention, in which FIG. 13C is a cross-sectional view taken along line C-C of FIG. 13D;

FIGS. 14A, 14B illustrate a status where the plug connector is connected to the receiving connector according to the fourth embodiment of the present invention, in which FIG. 14B is a cross-sectional view taken along line B-B of FIG. 14A;

FIGS. 16A, 16B illustrate the receiving connector of the connector device according to the fifth embodiment of the present invention, in which FIG. 16A is a cross-sectional view taken along line A-A of FIG. 16B;

FIGS. 20A through 20D illustrate the receiving connector and the cylindrical plug connector corresponding to each other according to the seventh embodiment of the present invention, in which FIG. 20C is a cross-sectional view taken along line C-C of FIG. 20D;

FIGS. 21A, 21B illustrate a status where the plug connector is connected to the receiving connector according to the seventh embodiment of the present invention, in which FIG. 21B is a cross-sectional view taken along line B-B of FIG. 21A;

FIGS. 23A, 23B illustrate the receiving connector of the connector device according to the eighth embodiment of the present invention, in which FIG. 23A is a cross-sectional view taken along line A-A of FIG. 23B;

DETAILED DESCRIPTION OF THE PREFERRED EMBODIMENTS

A description is given, with reference to the accompanying drawings, of an embodiment of the present invention.

FIGS. 25A through 25I schematically illustrate connected statuses of connector devices according to embodiments of the present invention described below.

First Embodiment

Figure 1:
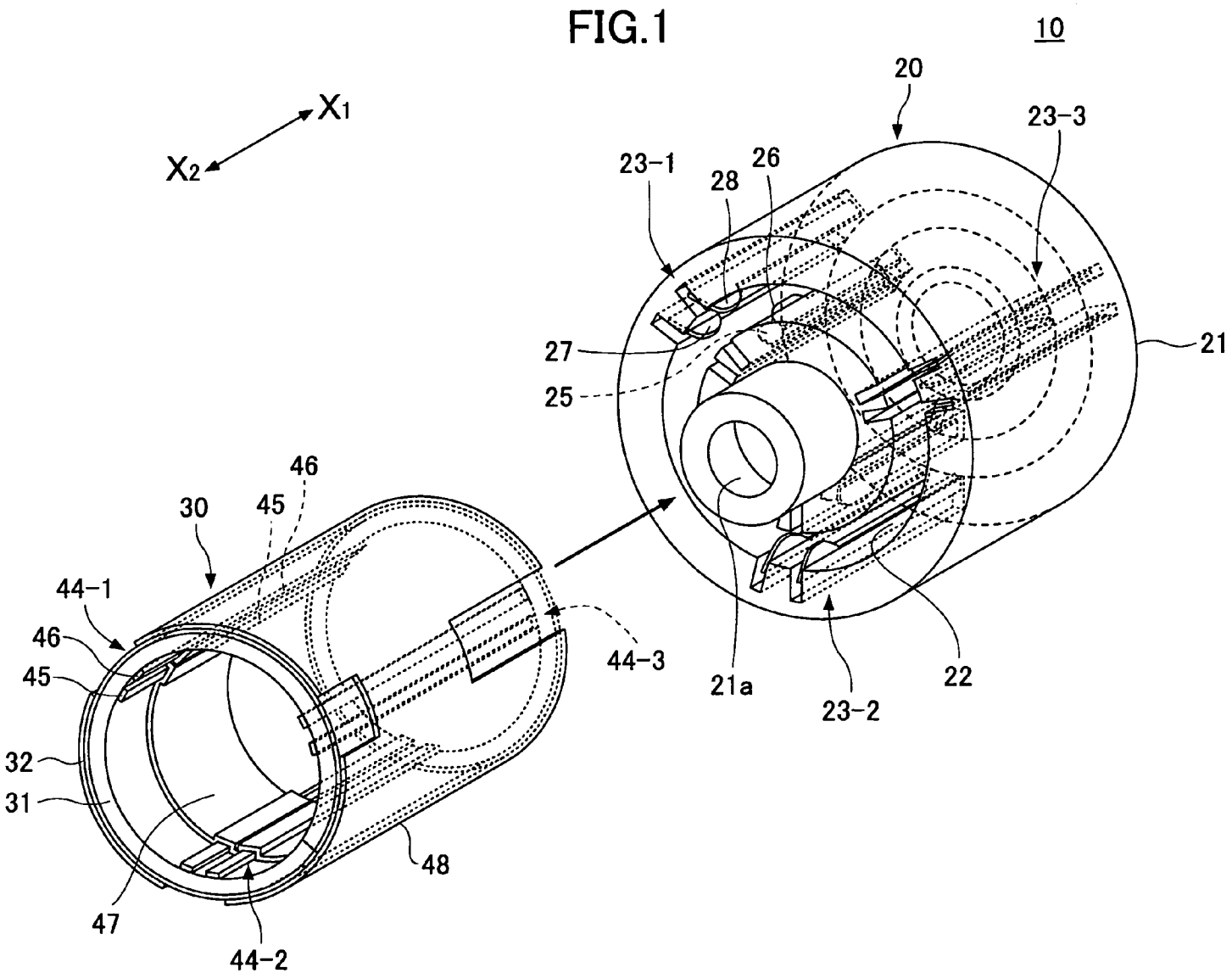
FIG. 1 is a perspective view of a connector device according to a first embodiment of the present invention, in which a receiving connector and a plug connector are shown facing each other.
Figure 2:
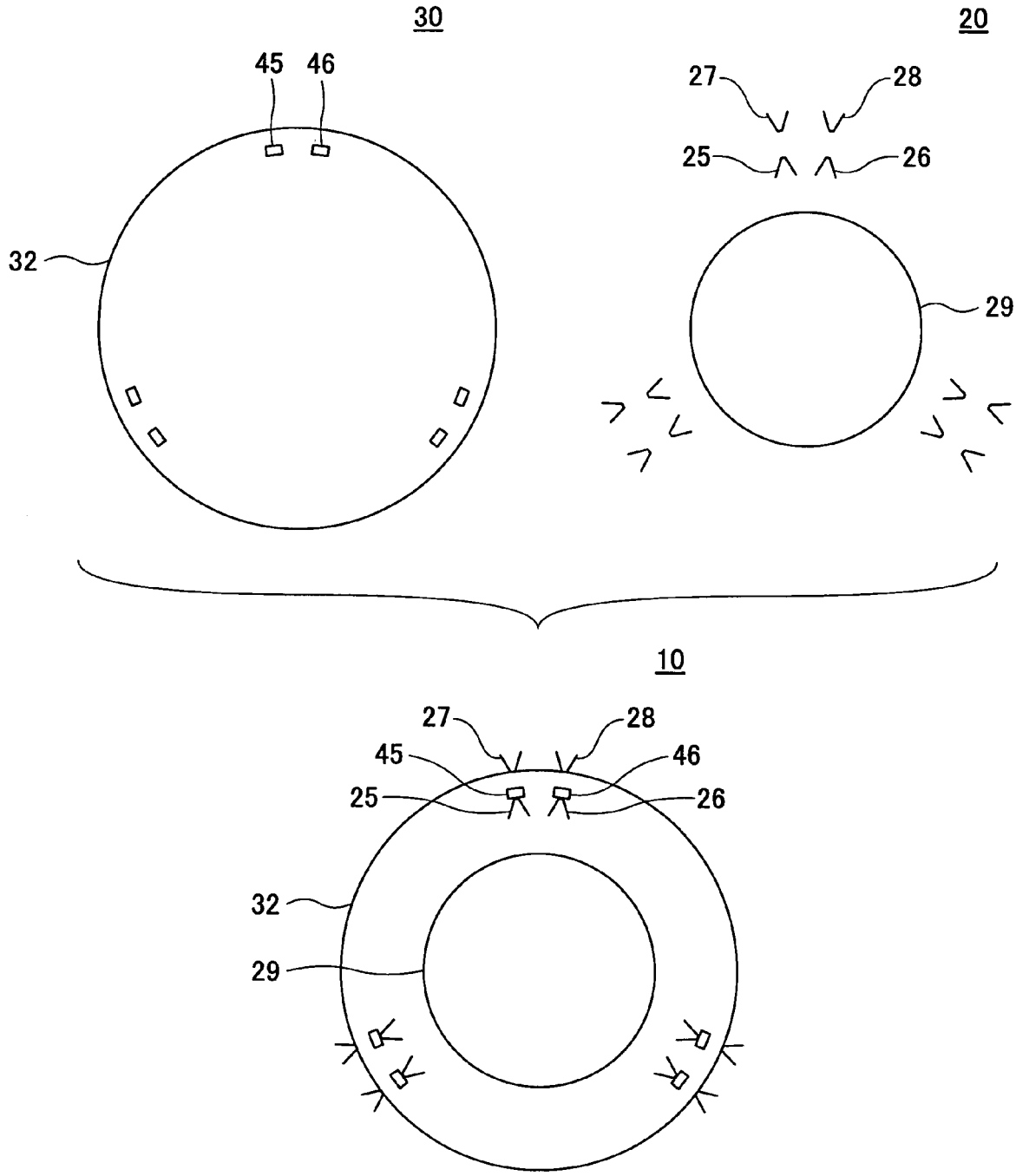
FIG. 2 is a diagram of the connector device shown in FIG. 1, schematically illustrating the receiving connector together with the plug connector.
Figure 3A:
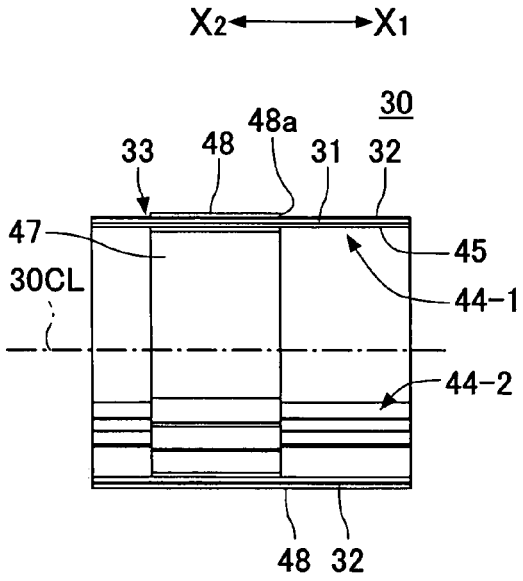
Figure 25A:
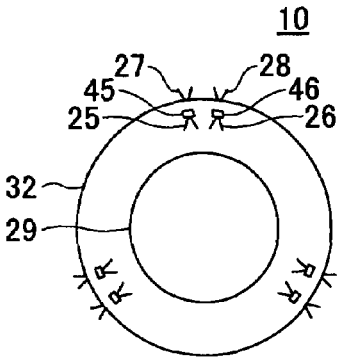
FIGS. 25A through 25I schematically illustrate connected statuses of the connector devices according to the embodiments of the present invention.

FIG. 1 is a perspective view of a connector device 10 according to a first embodiment of the present invention, in which a cylindrical receiving-side connector (hereinafter, "receiving connector") 20 and a cylindrical plug-in side connector (hereinafter, "plug connector") 30 included therein are shown facing each other. FIG. 2 is a schematic diagram of the connector device 10. FIGS. 3A through 3D illustrate the cylindrical receiving connector 20 and the cylindrical plug connector 30 corresponding to each other. The cylindrical plug connector 30 is inserted to the receiving connector 20 in a direction X1 and pulled out from the receiving connector 20 in a direction X2. FIG. 3B is a left side view of the plug connector 30 shown in FIG. 3A and FIG. 3D is a left side view of the receiving connector 20 shown in FIG. 3C. FIGS. 4A, 4B illustrate a status where the plug connector 30 is connected to the receiving connector 20. FIG. 25A is a schematic diagram of the connector device 10. The connector device 10 is applied to a balanced transmission line. Balanced transmission is a method of using two electric lines paired together for each set of data. Balanced transmission is performed to simultaneously transmit "+ signals" that are to be transmitted and "− signals" that have the same sizes as the + signals but are in the opposite direction.

[Structure of Plug Connector 30]

Figure 5A:
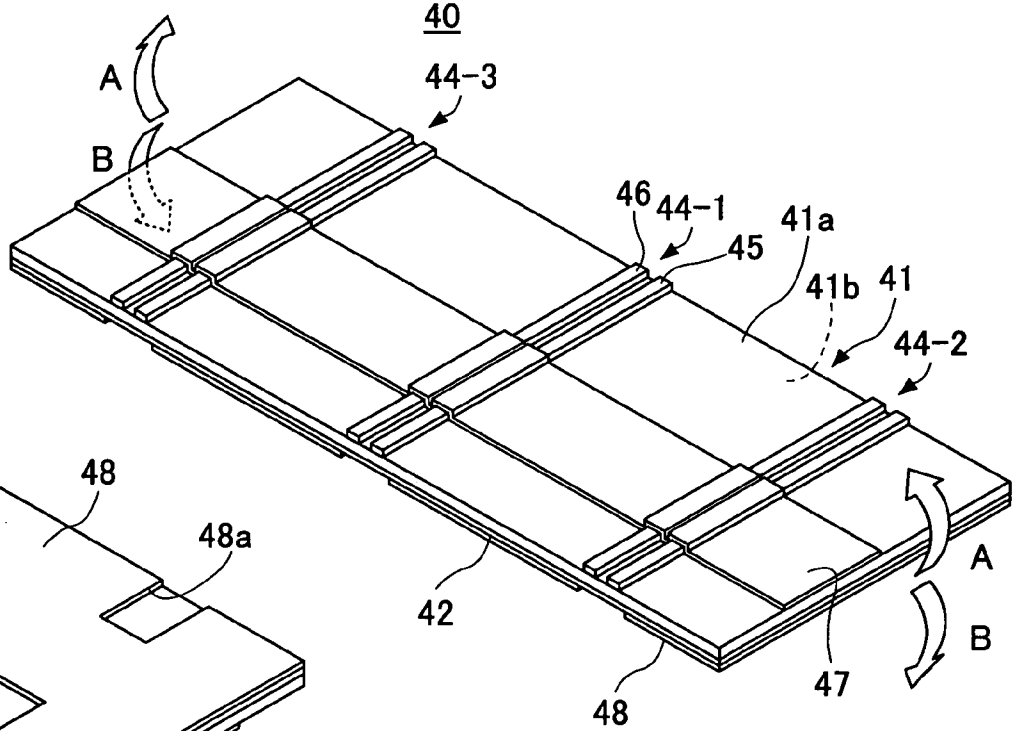
FIGS. 5A, 5B are perspective views of a sheet member.
Figure 5B:
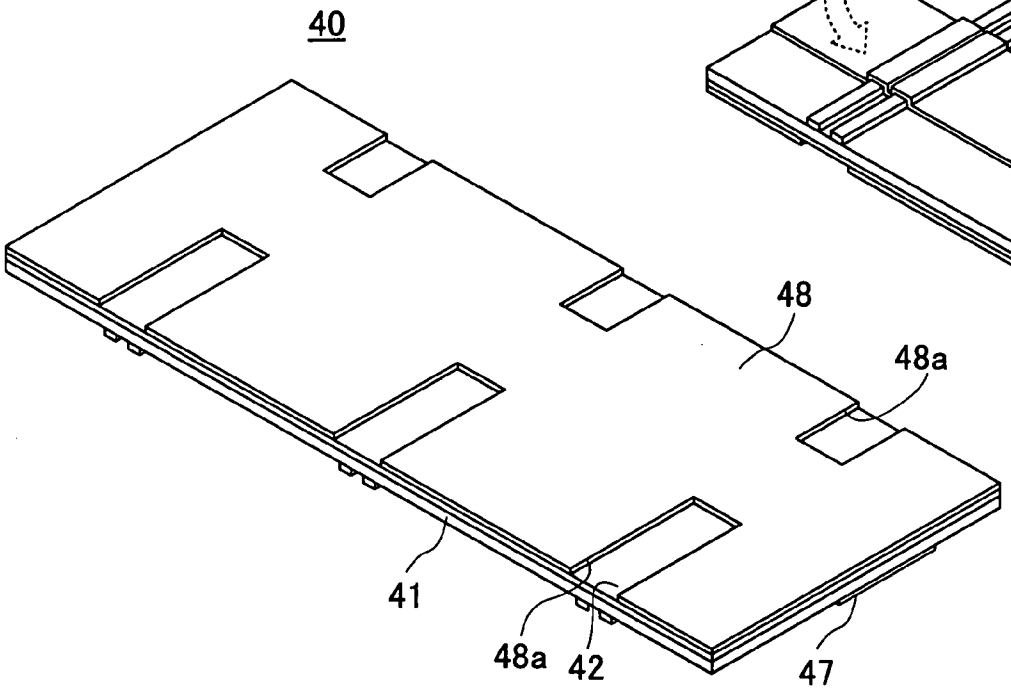

The plug connector 30 is formed by rolling (curving) a sheet member 40 shown in FIGS. 5A, 5B in a direction indicated by an arrow A, i.e., in a direction such that a ground pattern 42 acting as a ground unit faces the outside, thus forming a cylindrical shape. The sheet member 40 has the sheet-like ground pattern 42 deposited on the entire bottom surface 41*b* of a rectangular insulative sheet main body 41. On a top surface 41*a* of the insulative sheet main body 41, pairs of linear signal contact patterns 44-1 through 44-3 are equidistantly deposited, which patterns are part of the transmission path of signals. Large portions of the top surface 41*a* and the bottom surface 41*b* are covered by insulating films 47, 48, respectively. A reference numeral 48*a* denotes notch windows from which parts of the ground pattern 42 are exposed. Usually, multiple pairs of contact patterns are provided; however, only three pairs are illustrated as a matter of convenience. The pair of signal contact patterns 44-1 includes a first signal contact pattern 45 and a second signal contact pattern 46 acting as signal contact members.

By curving the sheet member 40 into a cylindrical shape in the above manner, a cylindrical insulating unit 31 is formed with the sheet main body 41 as shown in FIGS. 3A, 3B. On the entire outer peripheral surface of the cylindrical insulating unit 31, a cylindrical ground pattern 32 acting as the ground unit is formed. The pairs of signal contact patterns 44-1 through 44-3 are equidistantly arranged along the inner periphery of the cylindrical insulating unit 31. Two opposite edges of the sheet member 40 are joined and fixed to each other at a portion 49. One of the pairs of signal contact patterns 44-1 includes the first signal contact pattern 45 and the second signal contact pattern 46. The first and second signal contact patterns 45, 46 are parallel with an axial line 30CL of the plug connector 30.

A main unit of the plug connector 30 is denoted by 33.

For example, the plug connector 30 is provided in such a manner that in the main unit 33, each signal contact pattern is connected with a corresponding pair wire at the edge of a cable (not shown) including plural pair wires.

The plug connector can be manufactured by a method other than that described above. For example, signal contact conductor wires acting as the signal contact members and a cylindrical ground member acting as the ground unit can be built in a resin-molded cylindrical insulator. In this case, the plug connector would have the signal contact conductor wires arranged in a circumferential direction instead of the first and second signal contact patterns 45, 46. Moreover, the plug connector would have the cylindrical ground member made by press-molding a metal sheet acting as the ground unit instead of the cylindrical ground pattern 32, which cylindrical ground member would be arranged along the inner periphery of the cylindrical insulator.

[Structure of Receiving Connector 20]

Figure 3C:
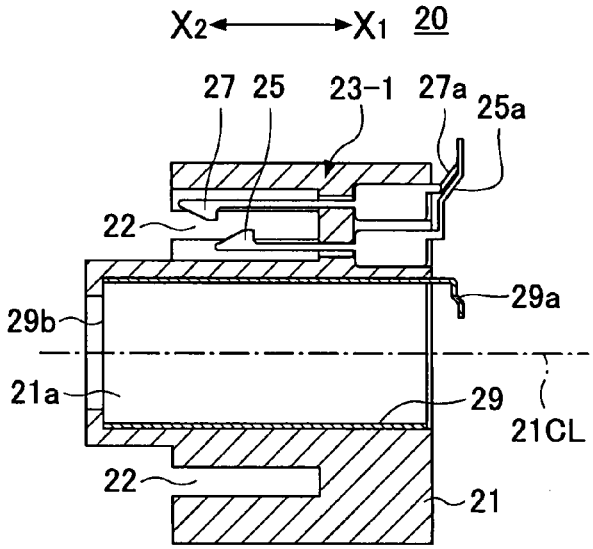
Figure 3B:
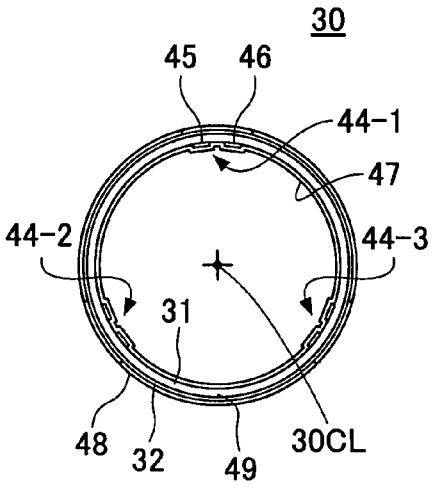
Figure 3D:
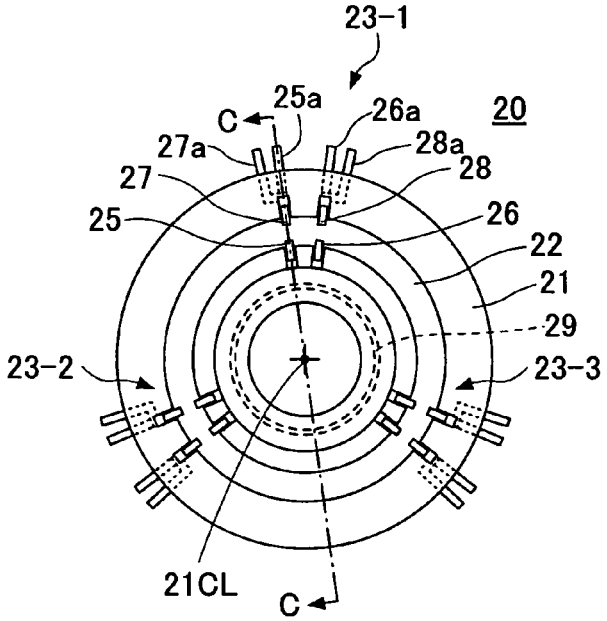
Figure 4B:
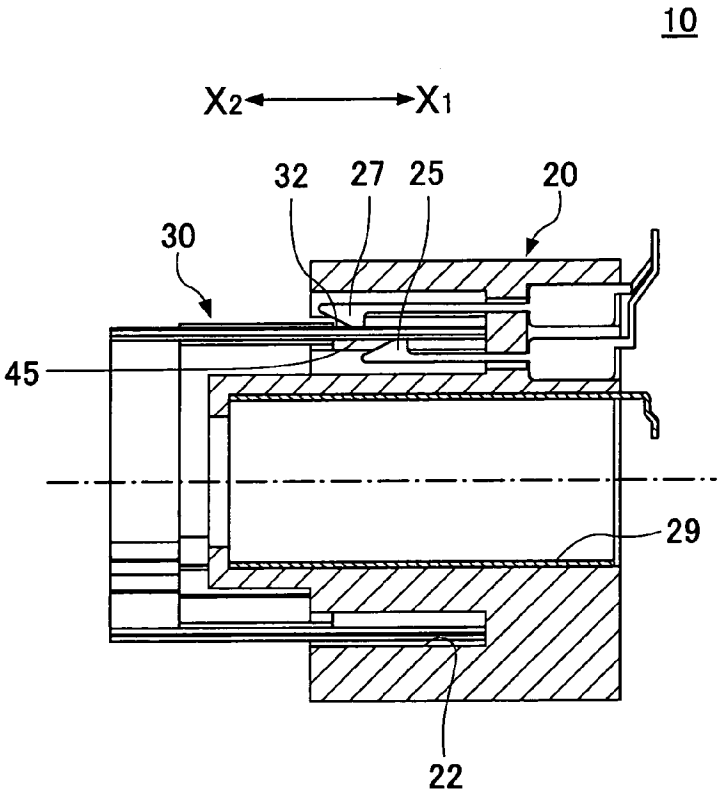
Figure 4A:
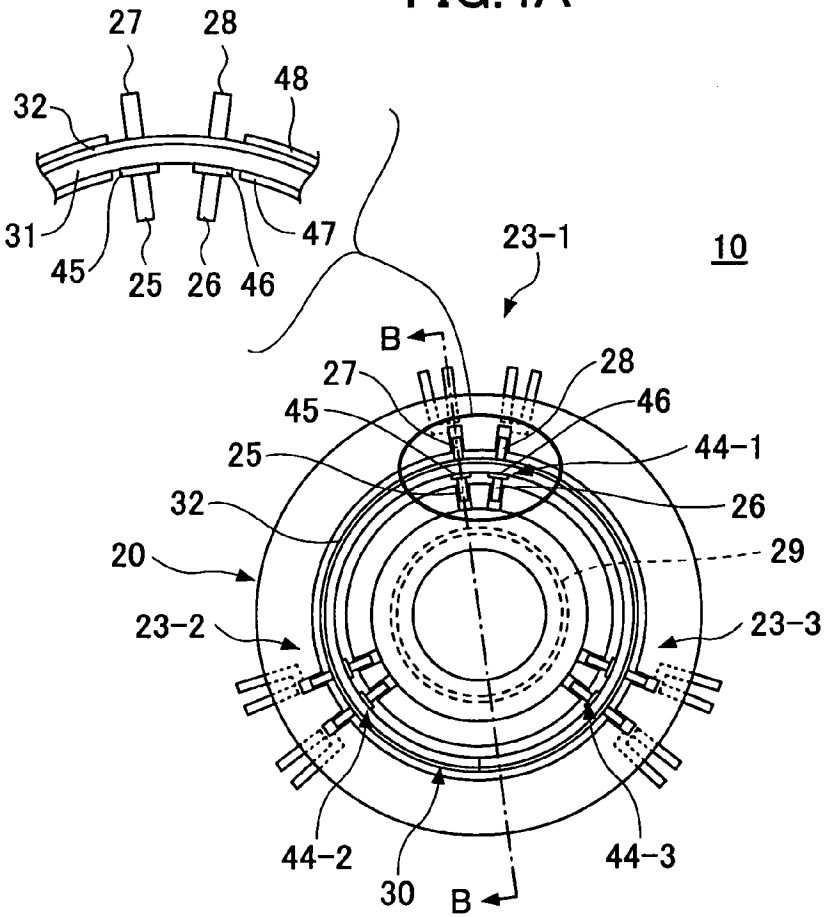

As shown in FIGS. 1, 3C, and 3D, the receiving connector 20 includes an insulator block 21, three groups of contact pieces 23-1 through 23-3 built in the insulator block 21 in such a manner as to face the pairs of signal contact patterns 44-1 through 44-3, and a single ground member 29 built in the center of the insulator block 21.

The insulator block 21 is substantially cylindrical, has a through hole 21*a* in its center, and has a toroidal space 22 into which the plug connector 30 is inserted, which space 22 is recessed from the surface of the insulator block 21 on the X2 side.

The group of contact pieces 23-1 includes a first signal contact piece 25, a second signal contact piece 26, and ground contact pieces 27, 28. The first signal contact piece 25 is provided in such a manner as to face the first signal contact pattern 45, and to be closer to the center than the space 22, with a part thereof protruding into the space 22. The second signal contact piece 26 is provided in such a manner as to face the second signal contact pattern 46, closer to the center than the space 22, with a part thereof protruding into the space 22. The ground contact pieces 27, 28 are provided closer to the outer periphery than the space 22, respectively facing the first and second signal contact patterns 45, 46, with parts thereof protruding into the space 22. As described below, the first signal contact piece 25 and the ground contact piece 27 sandwich a portion of the plug connector 30; the second signal contact piece 26 and the ground contact piece 28 sandwich another portion of the plug connector 30. The first signal contact piece 25 and the ground contact piece 27 are aligned on a plane passing through an axial line 21CL of the insulator block 21 and the second signal contact piece 26 and the ground contact piece 28 are aligned on another plane passing through the center of the insulator block 21, which pieces are arranged in a radial manner. The first signal contact piece 25, the second signal contact piece 26, and the ground contact pieces 27, 28 have leg parts 25*a*, 26*a*, 27*a*, and 28*a* that protrude above the surface of the insulator block 21 on the X1 side.

The other groups of contact pieces 23-2 and 23-3 have the same structure as the group of contact pieces 23-1.

The ground member 29 is cylindrical, and is provided closer to the center than the toroidal space 22 and closer to the center than the first and second signal contact pieces 25, 26 of the groups of contact pieces 23-1 through 23-3. A leading edge 29*b* of the ground member 29 is located further in the X2 direction than the leading edges of the first and second signal contact pieces 25, 26. The ground member 29 has a leg part 29*a*.

In the above-described receiving connector 20, the leg parts 25*a* through 29*a* are mounted on a pad of a printed-circuit board inside the device by soldering. The ground contact pieces 27, 28 and the ground member 29 have ground potential.

[Connected Status of Plug Connector 30 in Receiving Connector 20]

As shown in FIGS. 4A, 4B, 2, and 25A, the plug connector 30 is connected to the receiving connector 20 by being positioned at an appropriate position in its circumferential direction and by being sufficiently deeply inserted into the toroidal space 22 of the receiving connector 20. Looking at the pair of signal contact patterns 44-1 and the group of contact pieces 23-1, the first and second signal contact pieces 25, 26 on the inner periphery and the ground contact pieces 27, 28 on the outer periphery are sandwiching a cylindrical portion of the plug connector 30. The first signal contact pattern 45 and the first signal contact piece 25 are connected by contacting each other, and the second signal contact pattern 46 and the second signal contact piece 26 are connected by contacting each other. Pairs of signals are transmitted through these portions. The cylindrical ground pattern 32 and the ground contact pieces 27, 28 are connected by contacting each other, and have ground potentials.

The other pairs of signal contact patterns are also connected to the other contact pieces in the same manner as described above.

Accordingly, as shown in FIG. 3A, the cylindrical ground pattern 32 having ground potential surrounds not only all of the signal contact patterns but also all of the signal contact pieces. Thus, the portions where the signal contact patterns and the signal contact pieces contact each other have the same shielded structure as that of a coaxial cable. For this reason, electromagnetic noise from the outside is blocked in that the noise does not reach portions where signals are being transmitted. Consequently, the connector device 10 is highly resistant to electromagnetic noise from the outside.

As shown in FIGS. 3B and 3D, the cylindrical ground member 29 has a function of acting as a shield between pairs of signal contact patterns adjacent to each other in the circumferential direction, i.e., between the pair of signal contact patterns 44-1 and the pair of signal contact patterns 44-2, between the pair of signal contact patterns 44-2 and the pair of signal contact patterns 44-3, and between the pair of signal contact patterns 44-3 and the pair of signal contact patterns 44-1. This prevents interference from occurring between signals adjacent to each other in the circumferential direction, i.e., crosstalk is prevented from occurring in the connector device 10.

Second Embodiment

Figure 6:
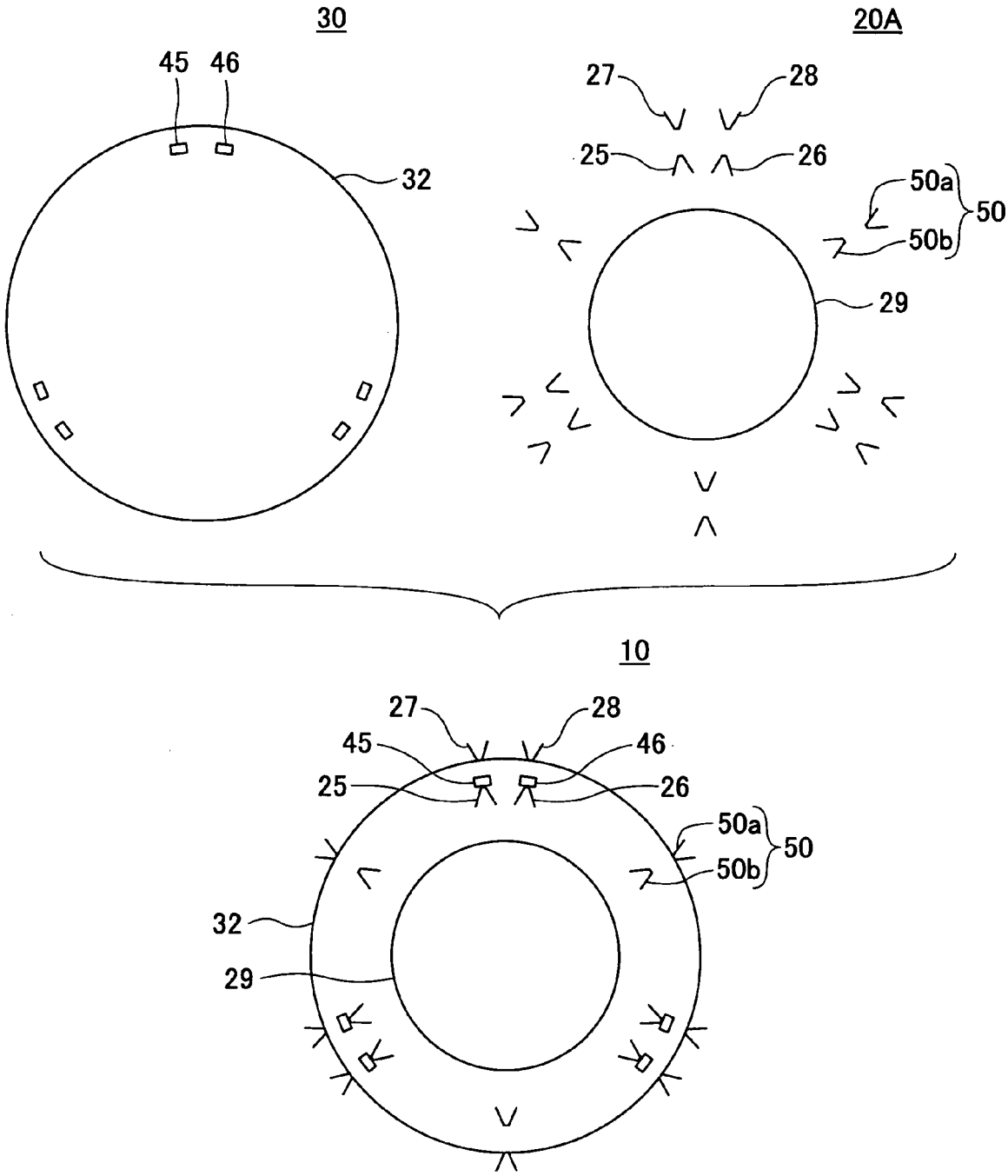
FIG. 6 is a diagram of a connector device according to a second embodiment of the present invention, schematically illustrating a receiving connector together with a plug connector.
Figure 25B:
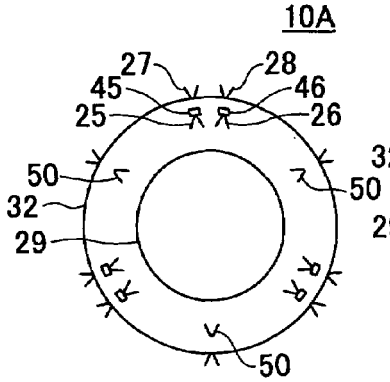

FIGS. 6 and 25B are schematic diagrams of a connector device 10A according to a second embodiment of the present invention. The connector device 10A includes a plug connector having the same configuration as the plug connector 30 and a receiving connector 20A schematically illustrated in FIGS. 7A, 7B.

The receiving connector 20A has a slightly different configuration to that of the receiving connector 20 described above. That is, contact members for ground (hereinafter, "ground contact member") 50 are additionally provided between the groups of contact pieces adjacent to each other in the circumferential direction, i.e., between the group of contact pieces 23-1 and the group of contact pieces 23-2, between the group of contact pieces 23-2 and the group of contact pieces 23-3, and between the group of contact pieces 23-3 and the group of contact pieces 23-1.

Figure 7A:
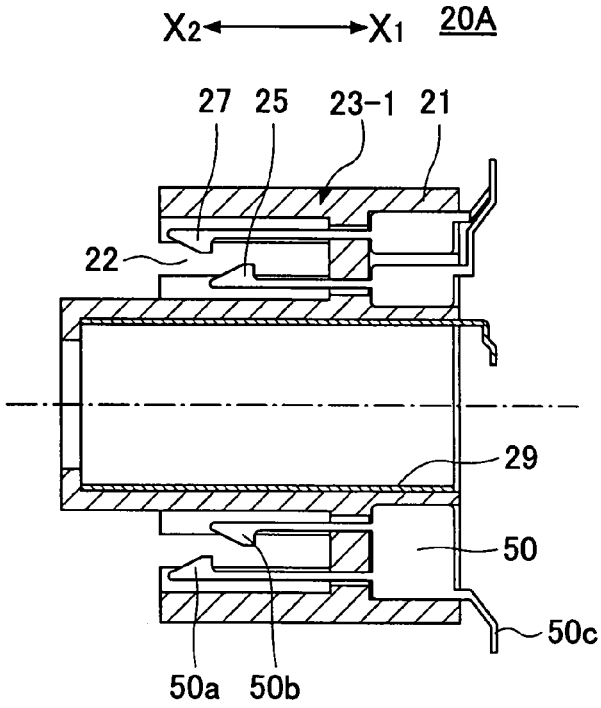
Figure 7B:
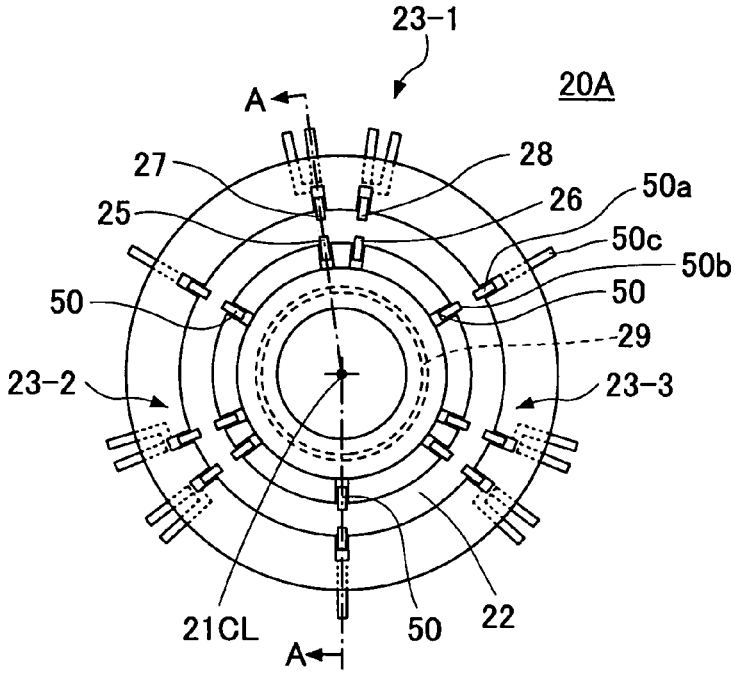

As shown in FIGS. 7A, 7B, each of the ground contact members 50 includes an outer contact piece 50*a* and an inner contact piece 50*b* provided opposite to each other across the toroidal space 22, and a leg part 50*c*. The outer contact piece 50*a* is arranged closer to the outer periphery than the toroidal space 22, and contacts the inserted ground pattern 32. The leg part 50*c* is mounted on a pad of a printed-circuit board by soldering. The ground contact member 50 has ground potential.

In a status where the plug connector 30 is connected to the receiving connector 20A, as shown in FIGS. 6 and 25A, the pairs of signals adjacent to each other in the circumferential direction are shielded from each other by the additionally provided ground contact members 50 and the cylindrical shielding ground member 29. Accordingly, in the connector device 10A, interference, i.e., crosstalk is further prevented from occurring between signals adjacent to each other in the circumferential direction, compared to the connector device 10.

Third Embodiment

Figure 8:
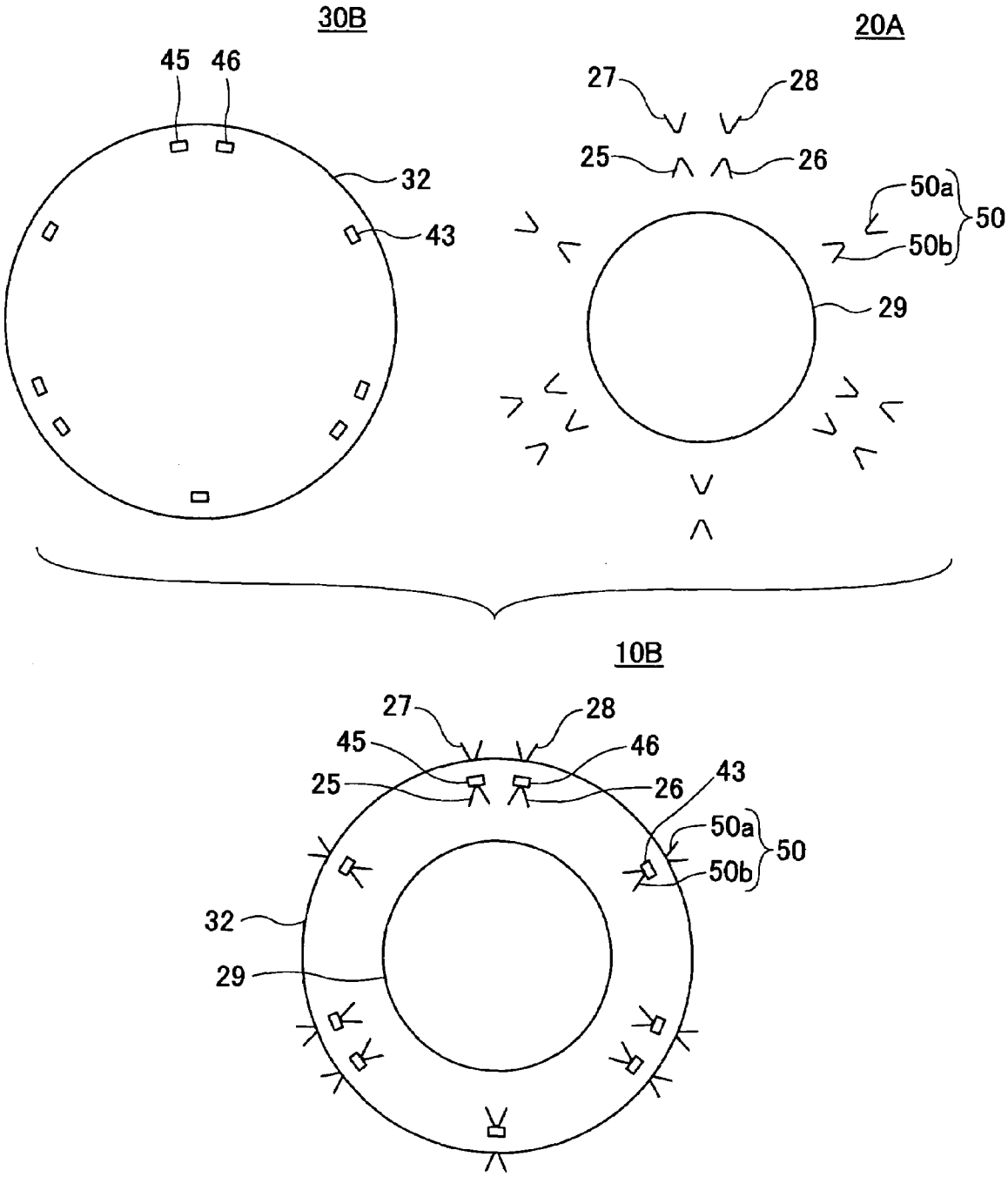
FIG. 8 is a diagram of a connector device according to a third embodiment of the present invention, schematically illustrating a receiving connector together with a plug connector.
Figure 9A:
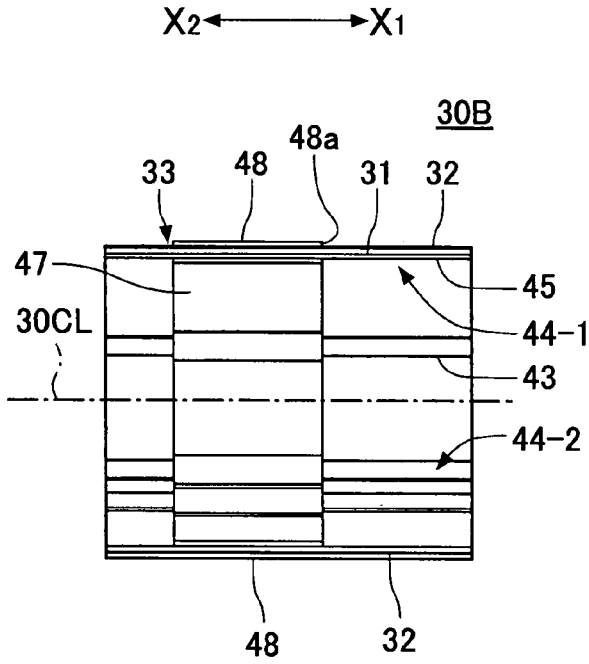
FIGS. 9A, 9B illustrate the plug connector of the connector device according to the third embodiment of the present invention.
Figure 9B:
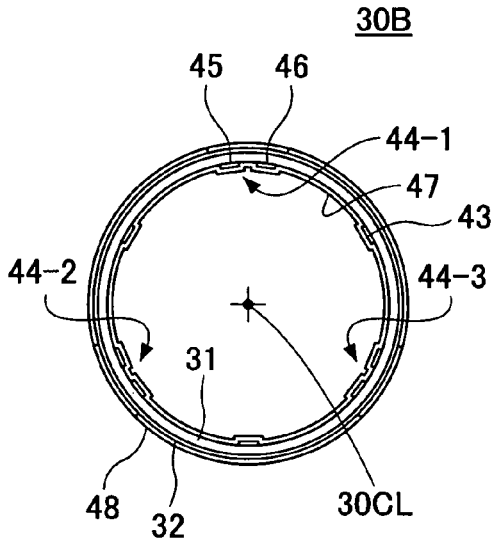
Figure 25C:
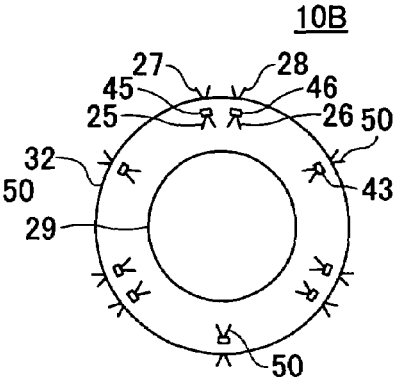
Figure 25D:
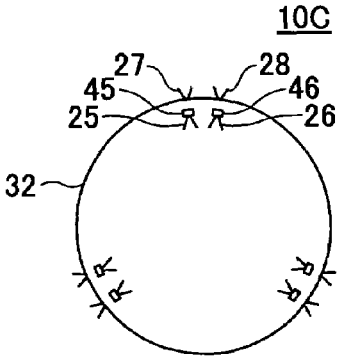

FIGS. 8 and 25C are schematic diagrams of a connector device 10B according to a third embodiment of the present invention. The connector device 10B includes a plug connector 30B shown in FIGS. 9A, 9B and the receiving connector 20A shown in FIGS. 7A, 7B.

The plug connector 30B is different from the plug connector 30 shown in FIGS. 2A, 2B in that ground contact patterns 43 acting as ground contact members are provided in between the pairs of signal contact patterns 44-1 through 44-3 adjacent to each other in the circumferential direction. The plug connector 30B is manufactured by curving a sheet member 40B shown in FIGS. 10A, 10B in a direction indicated by an arrow A, thus forming a cylindrical shape. The sheet member 40B is different from the sheet member 40 shown in FIGS. 5A, 5B in that the ground contact patterns 43 are provided. Each of the ground contact patterns 43 provided in between the adjacent pairs of signal contact patterns 44-1 through 44-3 extends in parallel with the signal contact patterns.

When the plug connector 30B is connected to the receiving connector 20A, as shown in FIGS. 8 and 25B, each of the ground contact patterns 43 is in contact with the inner contact piece 50*b* and the cylindrical ground pattern 32 is in contact with the outer contact piece 50*a*.

The pairs of signals adjacent to each other in the circumferential direction are shielded from each other by the additionally provided ground contact patterns 43, the cylindrical shielding ground member 29, and the ground contact member 50. Accordingly, in the connector device 10B, interference, i.e., crosstalk is even further prevented from occurring between signals adjacent to each other in the circumferential direction, compared to the connector device 10A.

Fourth Embodiment

Figure 11:
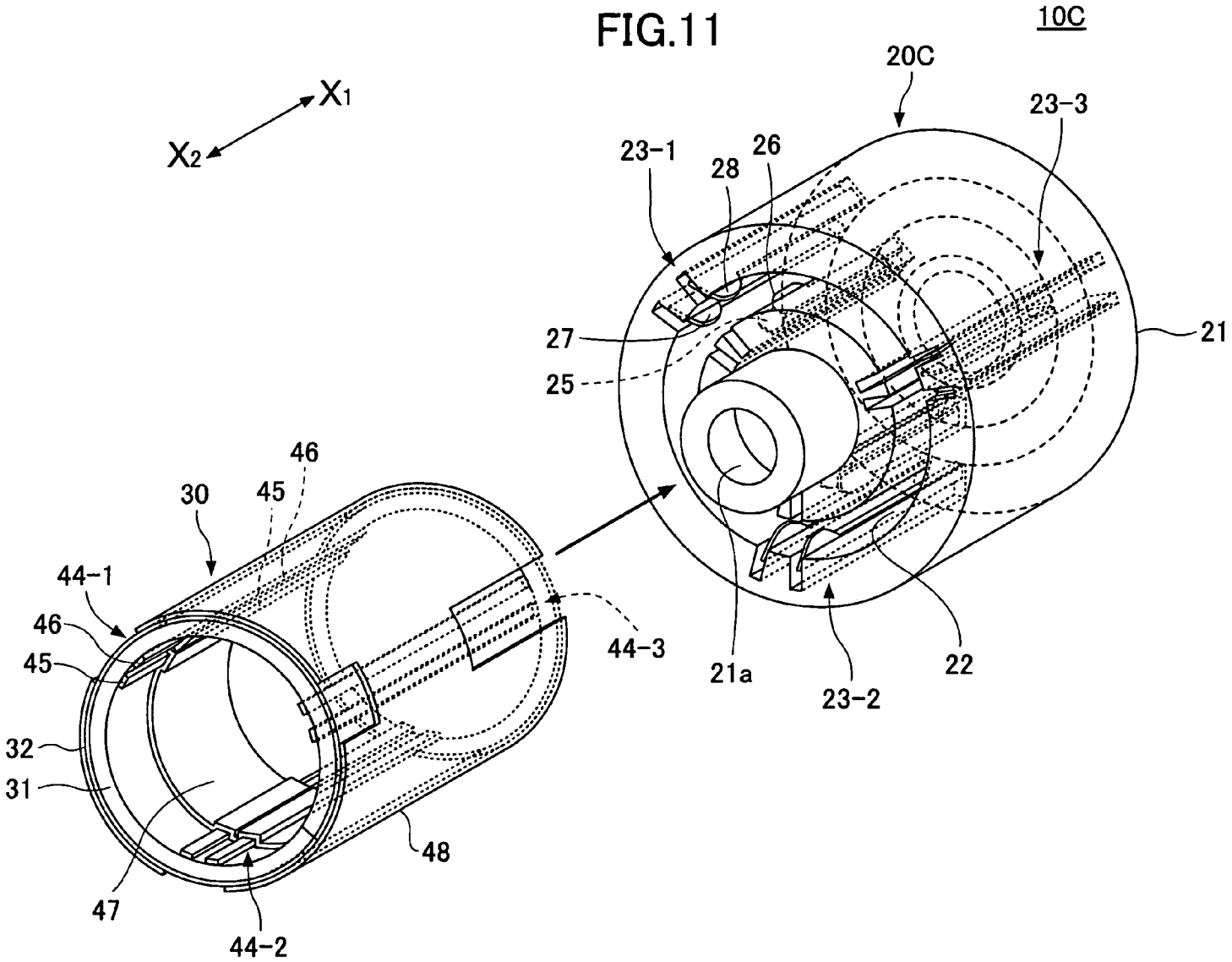
FIG. 11 is a perspective view of a connector device according to a fourth embodiment of the present invention, in which a receiving connector and a plug connector are shown facing each other.
Figure 12:
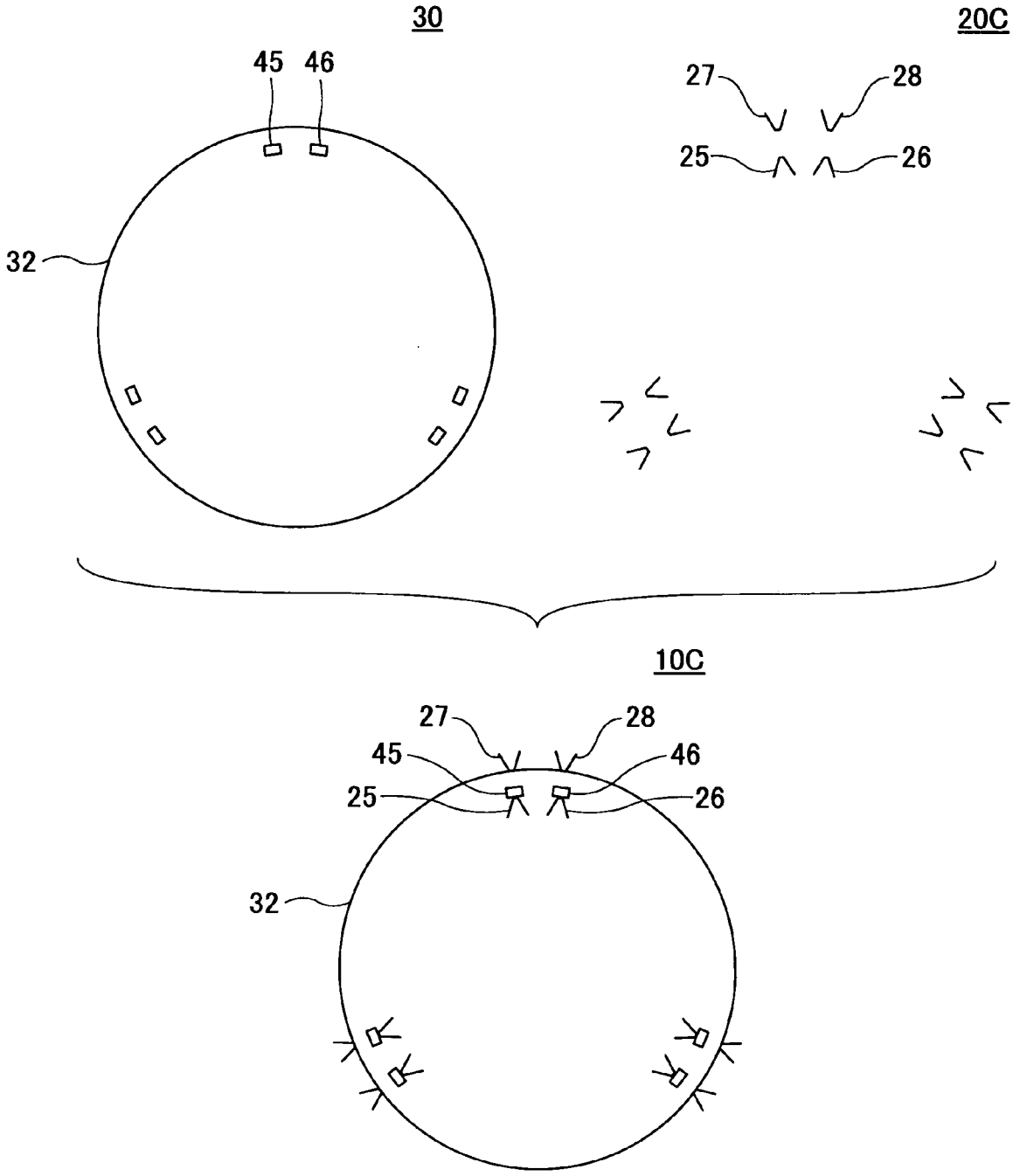
FIG. 12 is a diagram of the connector device according to the fourth embodiment of the present invention, schematically illustrating the receiving connector together with the plug connector.

FIG. 11 is a perspective view of a connector device 10C according to a fourth embodiment of the present invention, with a cylindrical receiving connector 20C facing the cylindrical plug connector 30. FIGS. 12 and 25C are schematic diagrams of the connector device 10C. FIGS. 13A through 13D illustrate the cylindrical receiving connector 20C and the cylindrical plug connector 30 corresponding to each other.

Figure 13A:
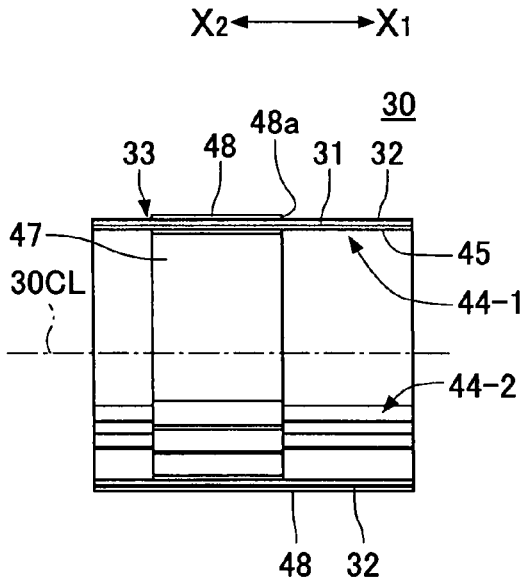
Figure 13C:
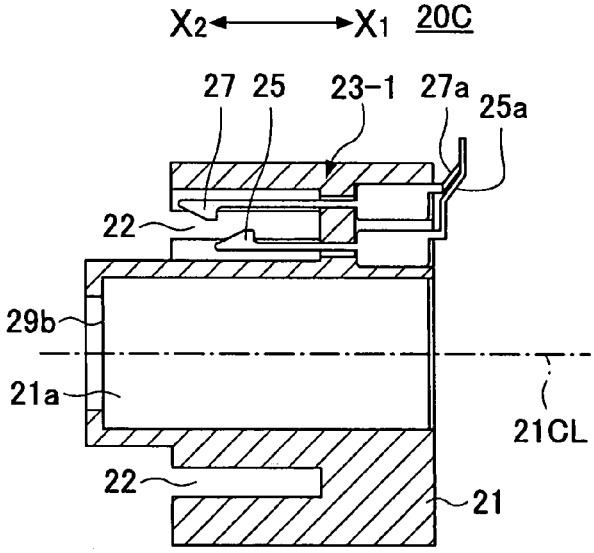
Figure 13B:
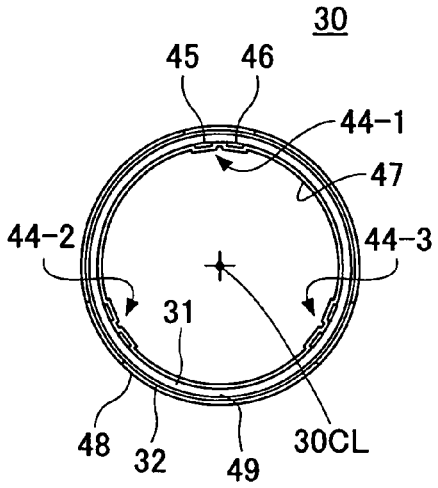
Figure 13D:
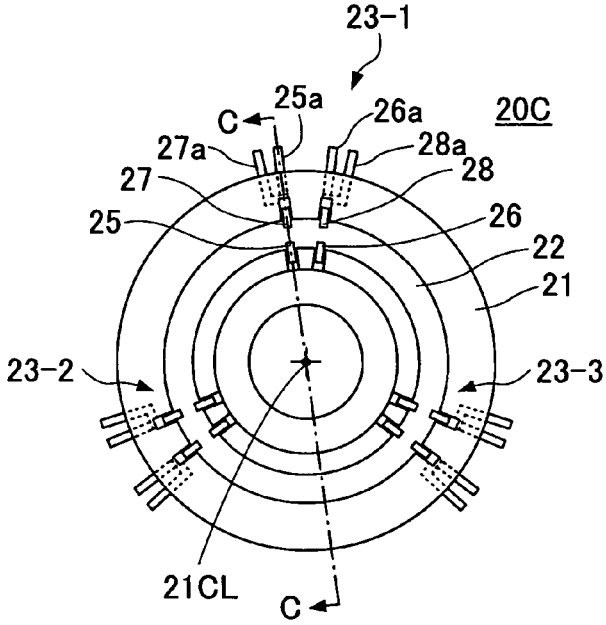
Figure 14B:
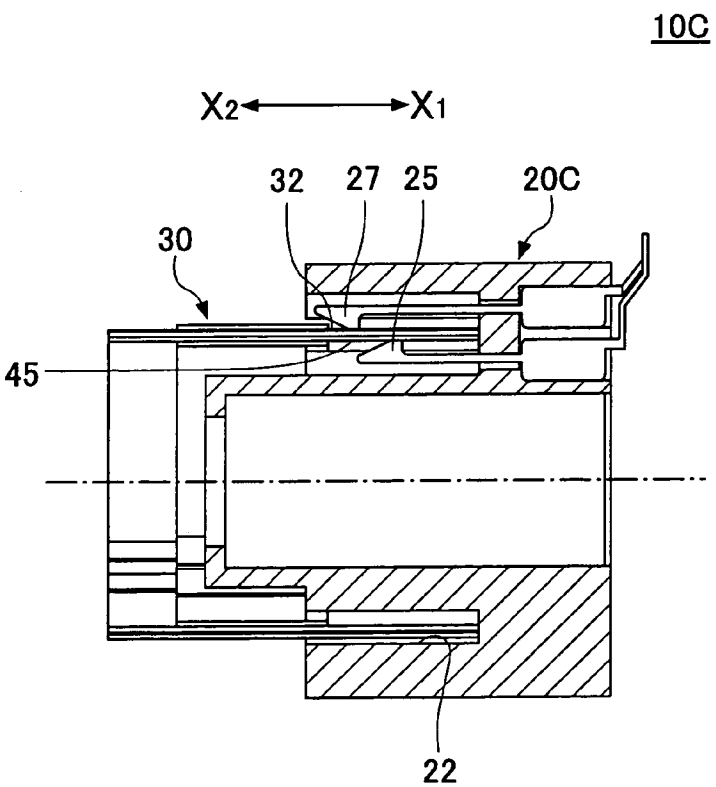
Figure 14A:
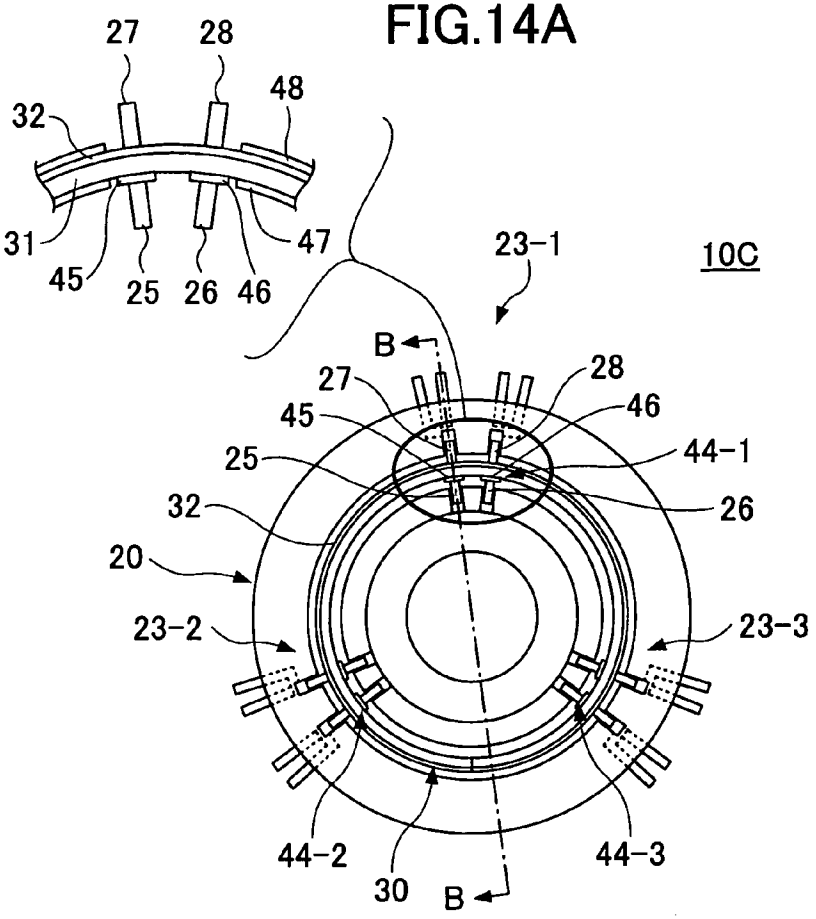

The connector device 10C includes the plug connector 30 shown in FIGS. 13A, 13B and the receiving connector 20C shown in FIGS. 13C, 13D.

The plug connector 30 has the same configuration as the plug connector 30 in the connector device 10 according to the first embodiment of the present invention.

The receiving connector 20C has a slightly different configuration from the receiving connector 20 of the connector device 10 according to the first embodiment of the present invention, i.e., the ground member 29 is not included.

As shown in FIGS. 14A, 14B, 12, and 25D, the plug connector 30 is connected to the receiving connector 20C.

The portions where the signal contact patterns and the signal contact pieces contact each other are shielded by the ground pattern 32 and thus have the same shielded structure as that of a coaxial cable. For this reason, electromagnetic noise from the outside is blocked by the cylindrical ground pattern 32 so as not to reach portions where signals are being transmitted. Consequently, the connector device 10C is highly resistant to electromagnetic noise from the outside.

Fifth Embodiment

Figure 15:
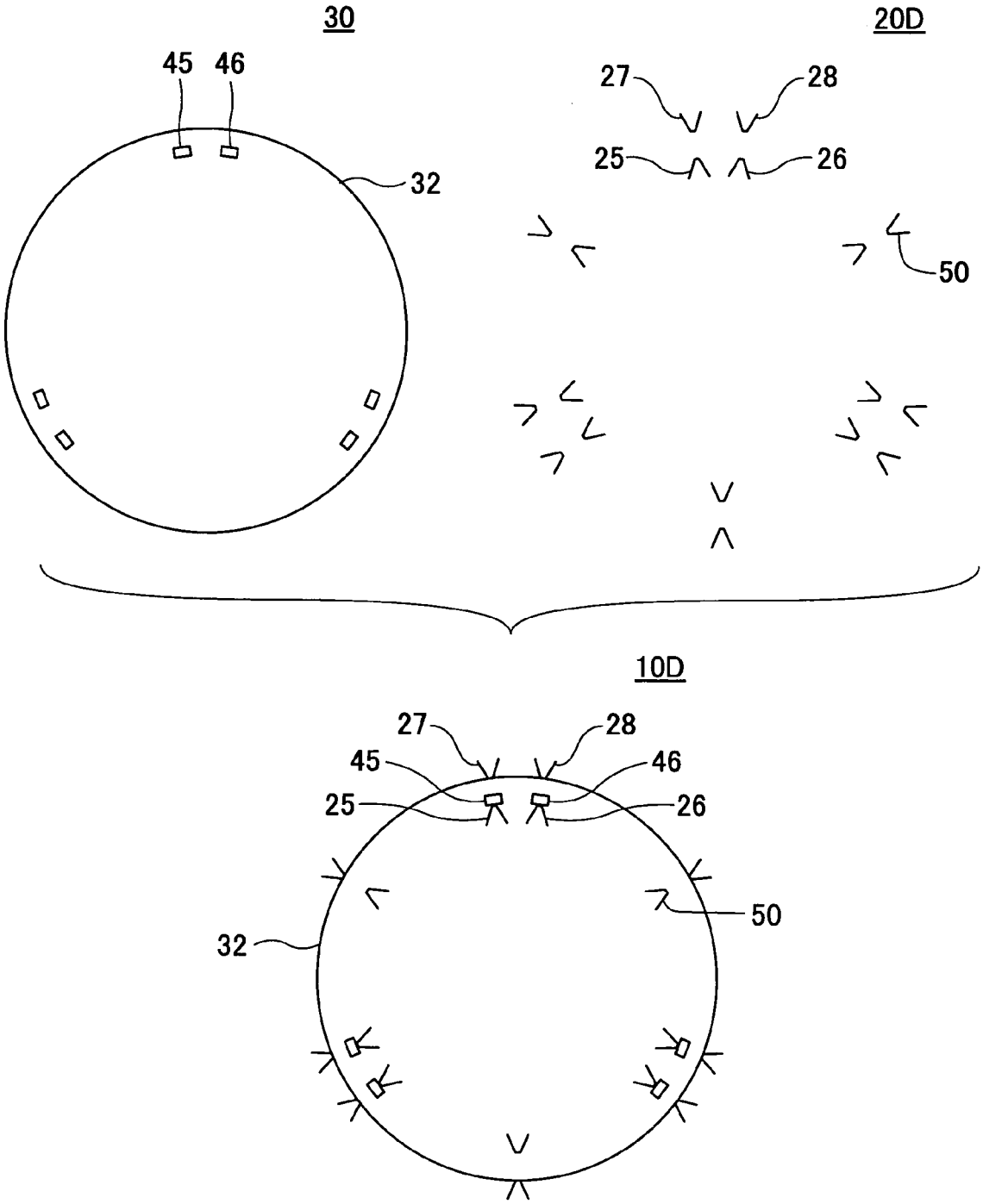
FIG. 15 is a diagram of a connector device according to a fifth embodiment of the present invention, schematically illustrating a receiving connector together with a plug connector.
Figure 16A:
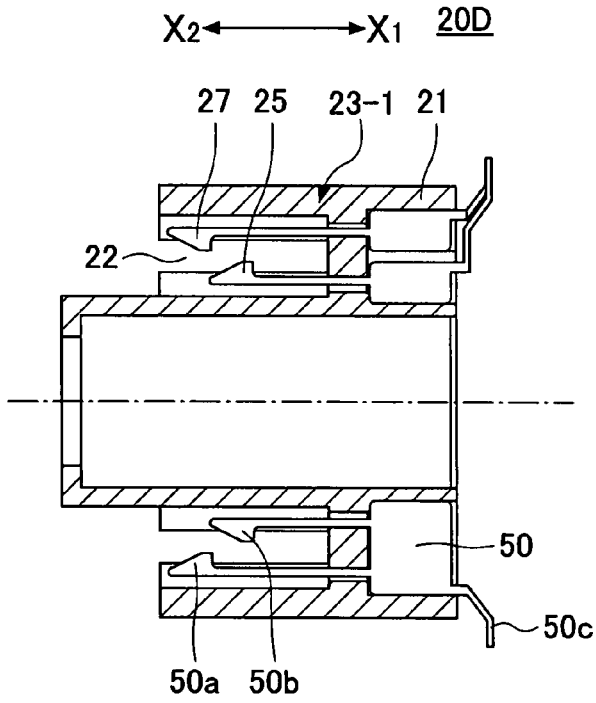
Figure 16B:
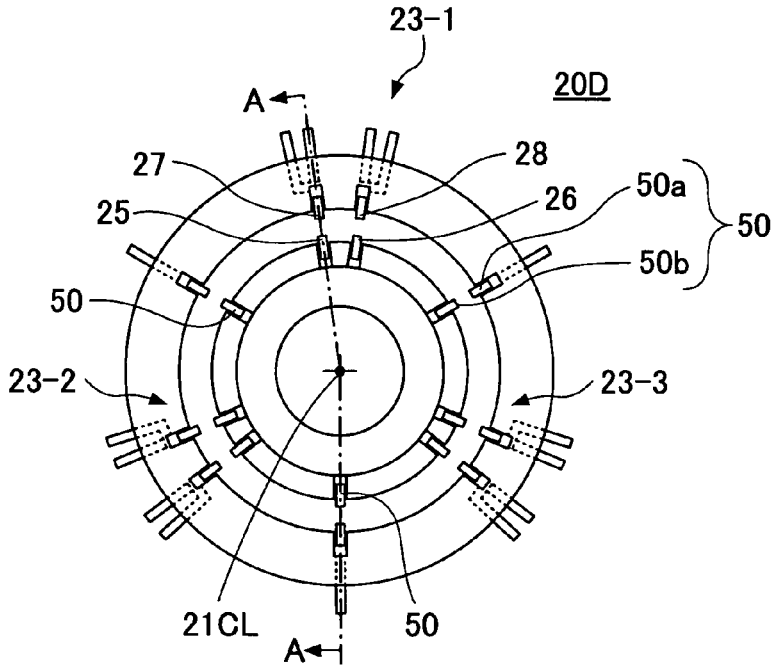
Figure 25E:
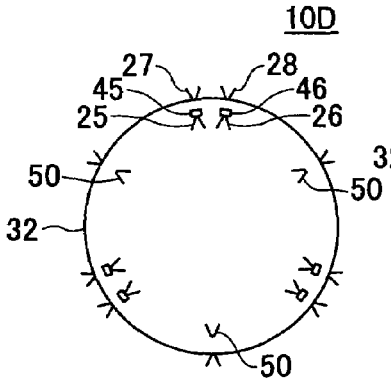

FIGS. 15 and 25E are schematic diagrams of a connector device 10D according to a fifth embodiment of the present invention. The connector device 10D includes the plug connector 30 described above and a receiving connector 20D shown in FIGS. 16A, 16B.

The receiving connector 20D has a slightly different configuration from the receiving connector 20A shown in FIG. 7, i.e., the ground member 29 is not included.

When the plug connector 30 is connected to the receiving connector 20C, as shown in FIGS. 15 and 25E, the pairs of signals adjacent to each other in the circumferential direction are shielded by the ground contact members 50. Accordingly, in the connector device 10D, interference is even further prevented from occurring between signals adjacent to each other in the circumferential direction, compared to the connector device 10C shown in FIG. 25D.

Sixth Embodiment

Figure 17:
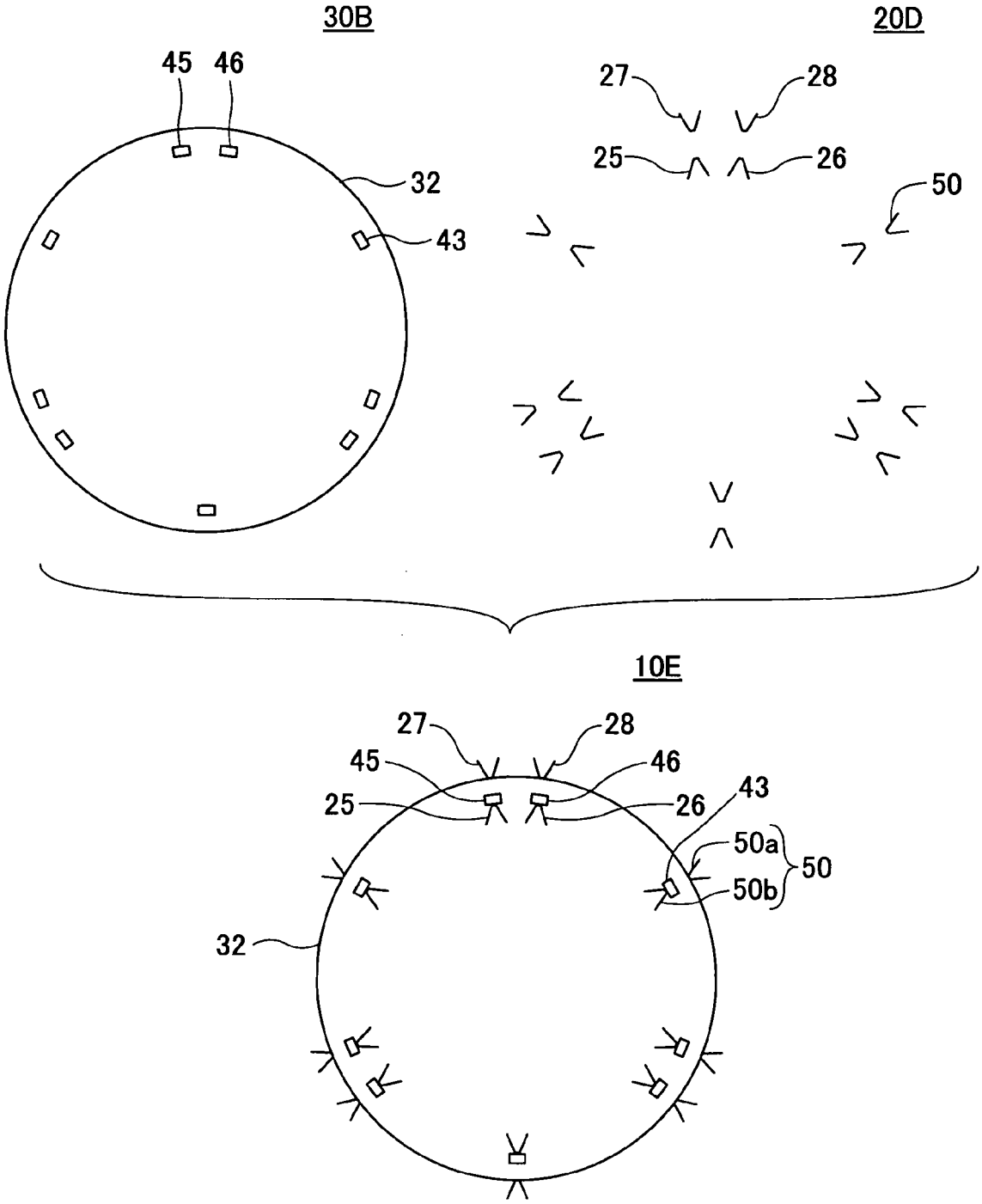
FIG. 17 is a diagram of a connector device according to a sixth embodiment of the present invention, schematically illustrating a receiving connector together with a plug connector.
Figure 25F:
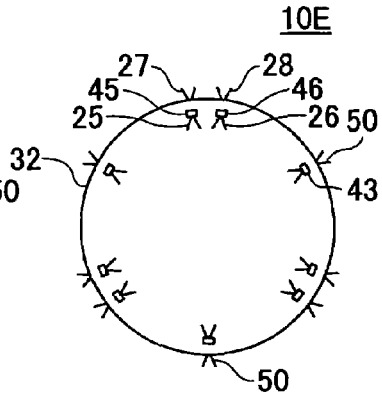

FIGS. 17 and 25F are schematic diagrams of a connector device 10E according to a sixth embodiment of the present invention. The connector device 10E includes the plug connector 30B shown in FIGS. 9A, 9B and the receiving connector 20D shown in FIGS. 16A, 16B.

When the plug connector 30B is connected to the receiving connector 20D, the ground contact patterns 43 are in contact with the inner contact piece 50*b* and the cylindrical ground pattern 32 is in contact with the outer contact piece 50*a*. Furthermore, the pairs of signals adjacent to each other in the circumferential direction are shielded by the ground contact patterns 43 as well as the ground contact member 50. Accordingly, in the connector device 10E, interference is even further prevented from occurring between signals adjacent to each other in the circumferential direction, compared to the connector device 10D.

Seventh Embodiment

Figure 18:
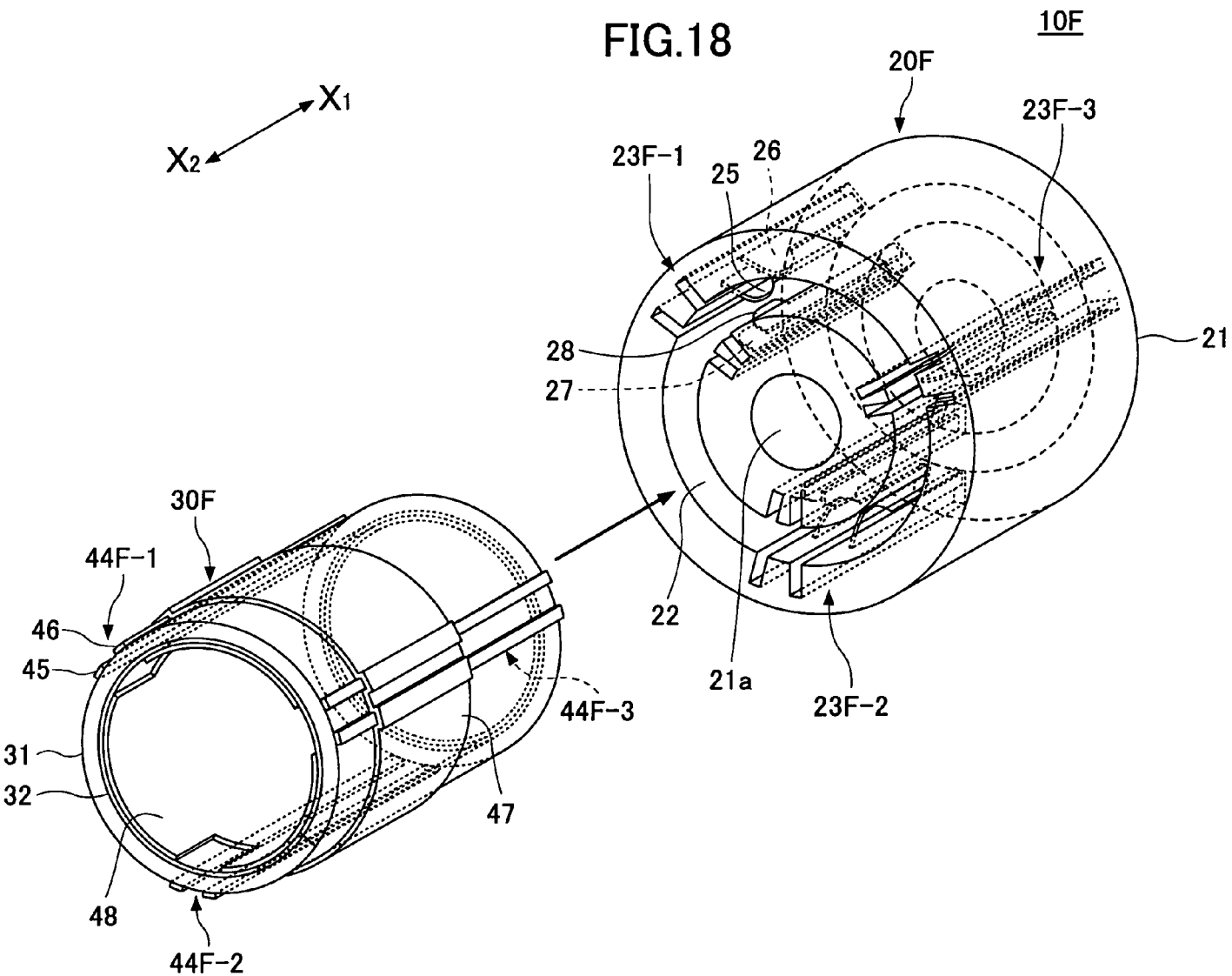
FIG. 18 is a perspective view of a connector device according to a seventh embodiment of the present invention, in which a receiving connector and a plug connector are shown facing each other.
Figure 19:
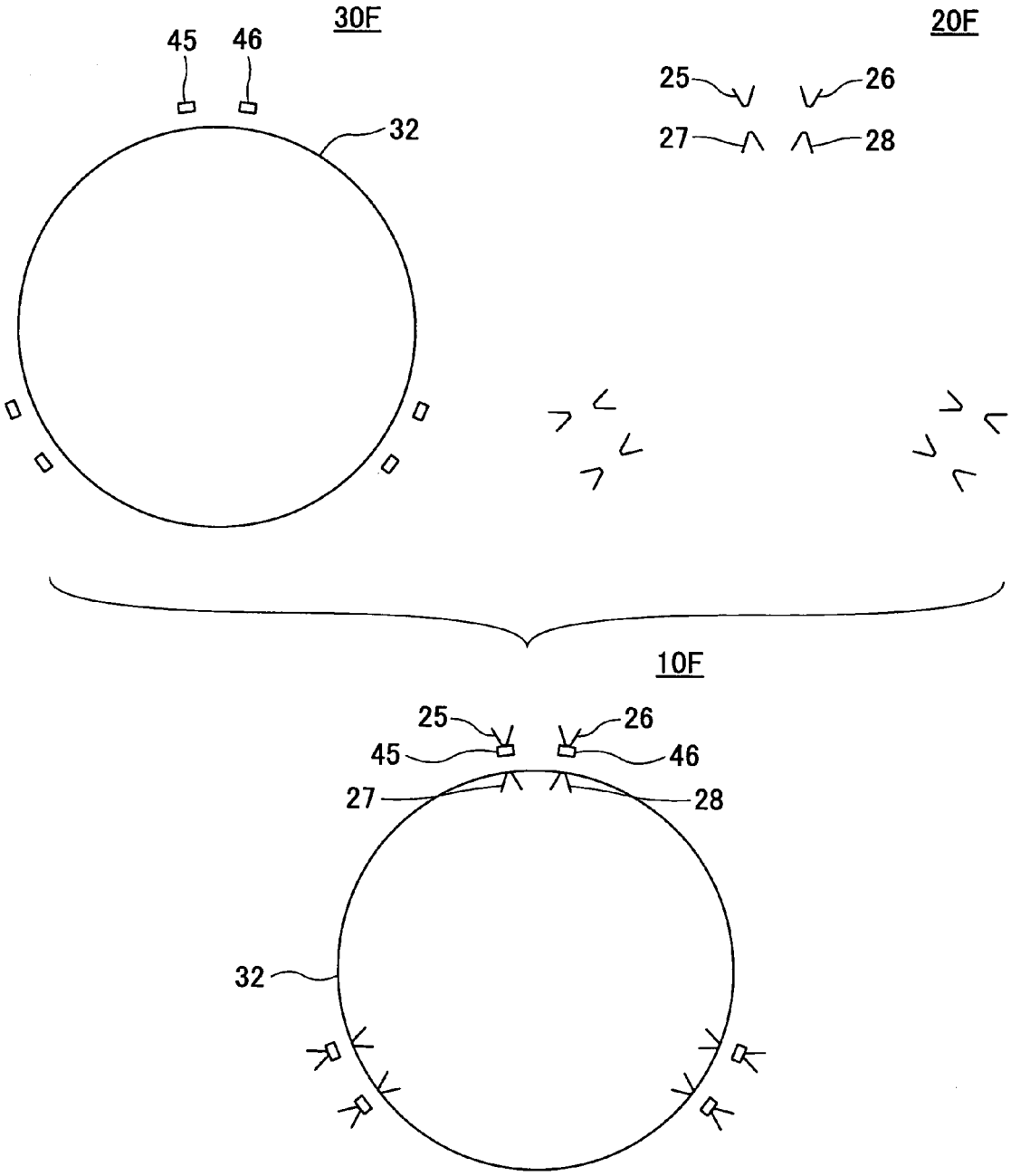
FIG. 19 is a diagram of the connector device according to the seventh embodiment of the present invention, schematically illustrating the receiving connector together with the plug connector.
Figure 25G:
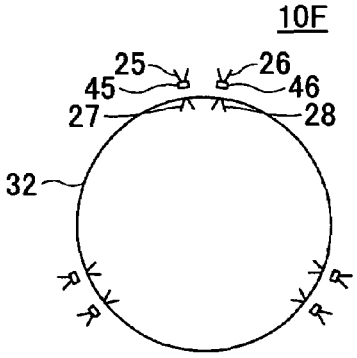

FIG. 18 is a perspective view of a connector device 10F according to a seventh embodiment of the present invention, with a cylindrical receiving connector 20F facing a cylindrical plug connector 30F. FIGS. 20A through 20D illustrate the cylindrical receiving connector 20F and the cylindrical plug connector 30F corresponding to each other. FIGS. 21A and 21B illustrate a status where the plug connector 30F is connected to the receiving connector 20F. FIGS. 19 and 25G are schematic diagrams of the connector device 10F. In these figures, elements corresponding to those in FIGS. 1 through 3D are denoted by the same reference numbers, and are not further described.

[Structure of Plug Connector 30F]

The plug connector 30F is formed by curving the sheet member 40 shown in FIGS. 5A, 5B in a direction indicated by an arrow B, i.e., in a direction such that the ground pattern 42 faces the inside, thus forming a cylindrical shape.

Figure 20A:
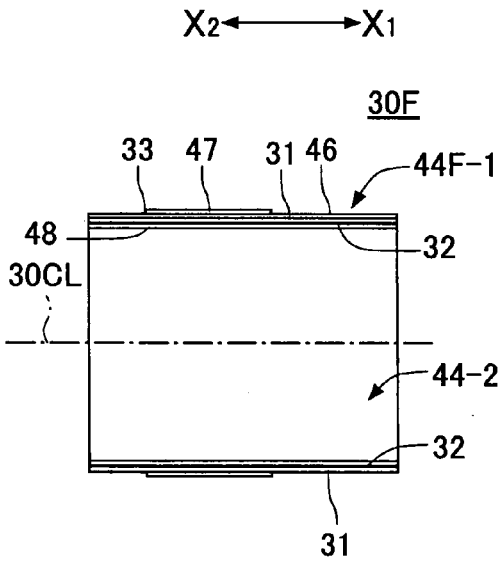
Figure 20C:
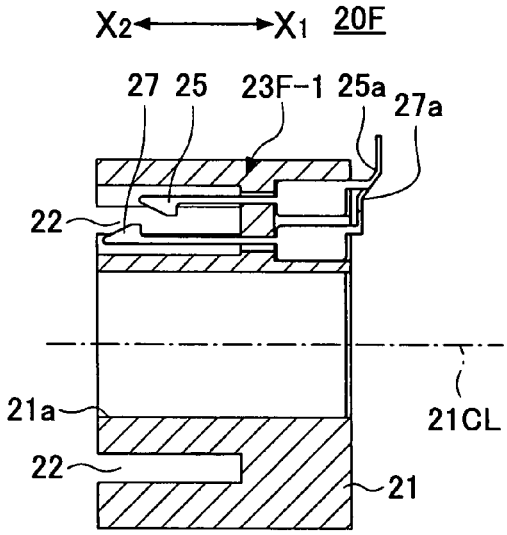
Figure 20B:
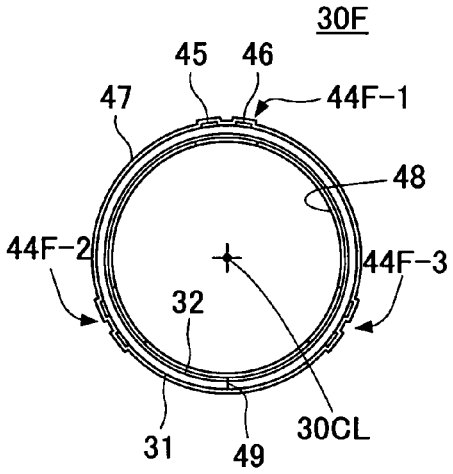
Figure 21B:
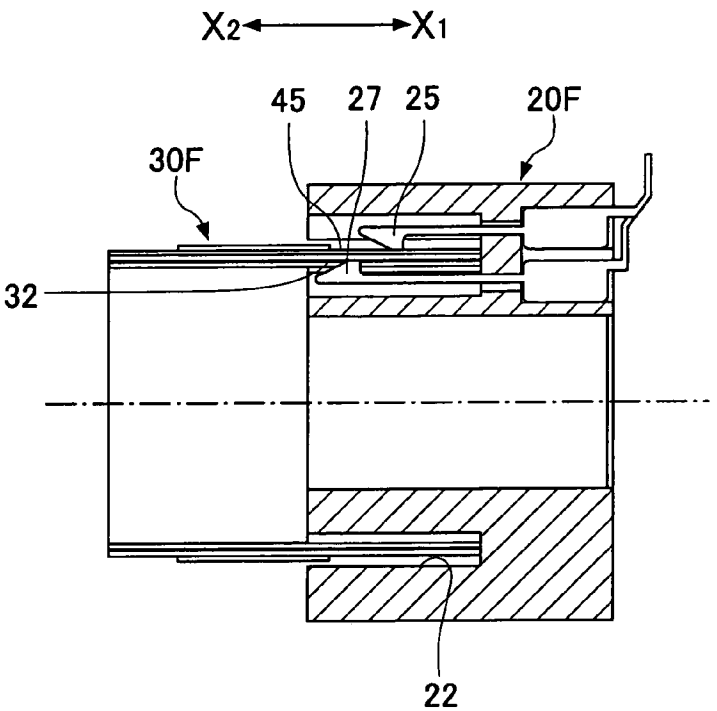
Figure 21A:
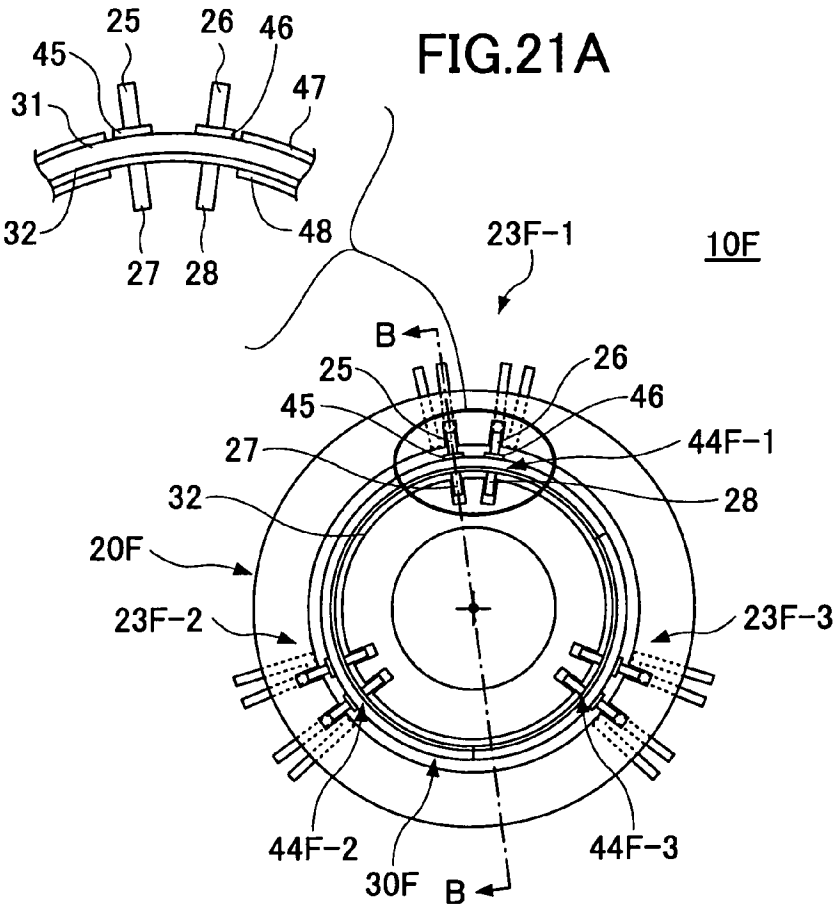

By curving the sheet member 40 into a cylindrical shape in the above manner, the cylindrical insulating unit 31 is formed as shown in FIGS. 20A, 20B. On the entire inner peripheral surface of the cylindrical insulating unit 31, the cylindrical ground pattern 32 is formed. Pairs of signal contact patterns 44F-1 through 44F-3 are equidistantly arranged along the outer periphery of the cylindrical insulating unit 31. Each of the pairs of signal contact patterns 44F-1 through 44F-3 includes the first signal contact pattern 45 and the second signal contact pattern 46. The first and second signal contact patterns 45, 46 are arranged on the opposite side with respect to the first embodiment; however, they are described as being on the same side as the first embodiment as a matter of convenience. The plug connector 30F is connected to the edge of a cable, for example.

[Structure of Receiving Connector 20F]

Figure 20D:
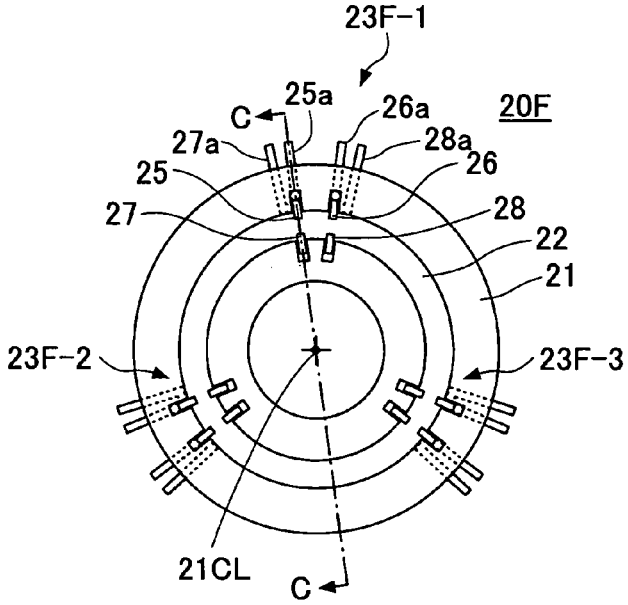

As shown in FIGS. 18, 20C, and 20D, the receiving connector 20F includes the insulator block 21 and three groups of contact pieces 23F-1 through 23F-3 built in the insulator block 21 in such a manner as to face the pairs of signal contact patterns.

The insulator block 21 is substantially cylindrical, and has the toroidal space 22 into which the plug connector 30 is inserted.

Each of the groups of contact pieces 23F-1 through 23F-3 includes the first signal contact piece 25, the second signal contact piece 26, and the ground contact pieces 27, 28. The first and second signal contact pieces 25, 26 face the first and second signal contact patterns 45, 46, respectively, and are provided closer to the outer periphery than the space 22, partially protruding into the space 22.

In the above-described receiving connector 20F, the leg parts 25*a* through 29*a* are mounted on a pad of a printed-circuit board inside the device by soldering. The ground contact pieces 27, 28 have ground potential.

[Connected Status of Plug Connector 30F in Receiving Connector 20F]

As shown in FIGS. 21A, 21B, and 25G, the plug connector 30F is connected to the receiving connector 20F by being positioned at an appropriate position in its circumferential direction and by being sufficiently deeply inserted into the toroidal space 22 of the receiving connector 20F. Looking at the pair of signal contact patterns 44F-1 and the group of contact pieces 23F-1, the first and second signal contact pieces 25, 26 on the outer periphery and the ground contact pieces 27, 28 on the inner periphery are sandwiching the cylindrical portion of the plug connector 30F. The first signal contact pattern 45 and the first signal contact piece 25 are connected by contacting each other, and the second signal contact pattern 46 and the second signal contact piece 26 are connected by contacting each other. Pairs of signals are transmitted through these portions. The cylindrical ground pattern 32 and the ground contact pieces 27, 28 are connected by contacting each other, and have ground potentials.

The other pairs of signal contact patterns are also connected to the other contact pieces in the same manner as described above.

Accordingly, portions where the pairs of signal contact patterns are connected to the contact pieces are arranged along the outer periphery of the cylindrical ground pattern 32 that has ground potential. The cylindrical ground pattern 32 has a curved shape that is configured to shield the adjacent pairs of signals from each other. Thus, in the connector device 10F, interference is prevented from occurring between pairs of signals adjacent to each other.

The cylindrical ground member 29 shown in FIG. 3C can be provided.

Eighth Embodiment

Figure 22:
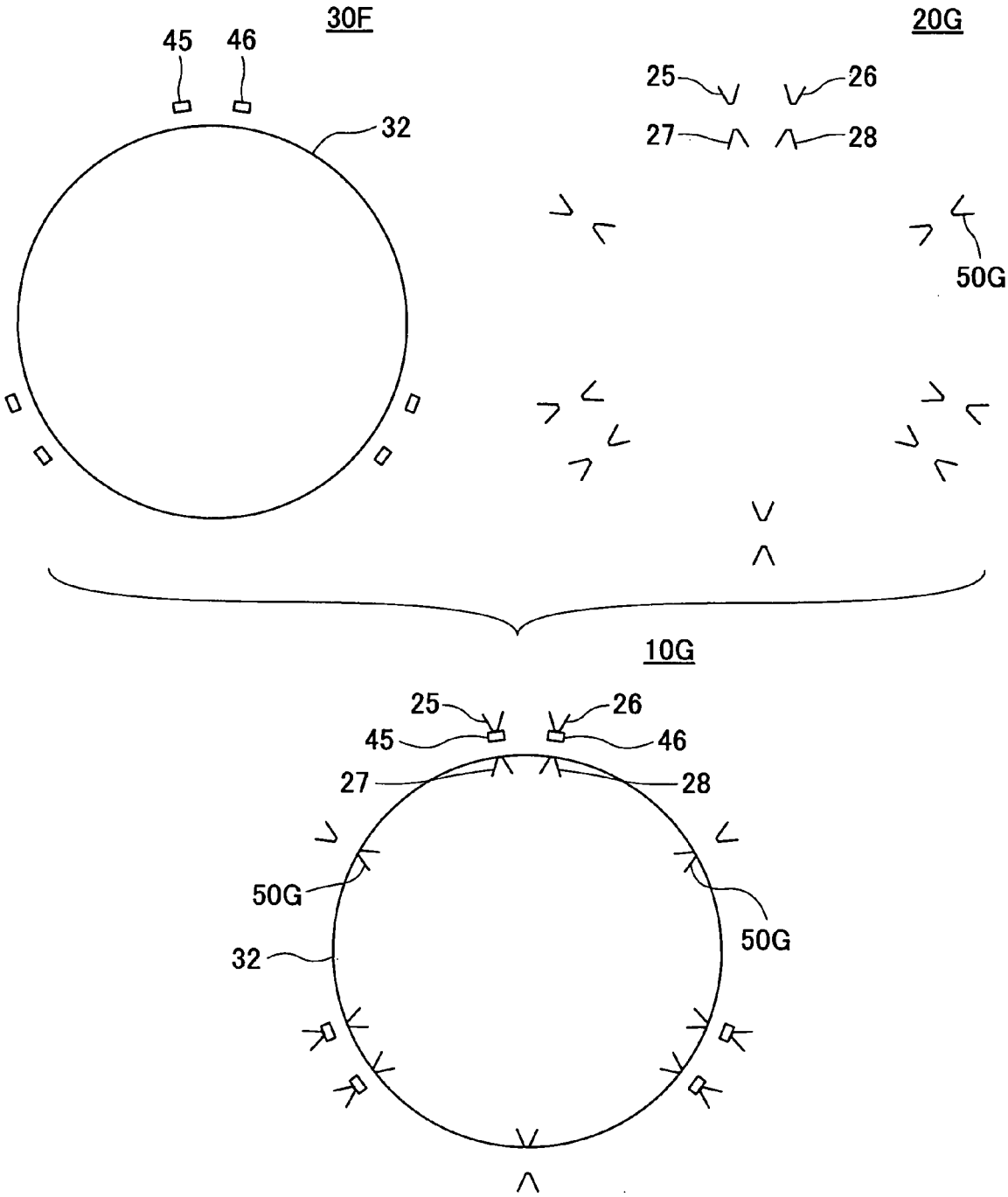
FIG. 22 is a diagram of a connector device according to an eighth embodiment of the present invention, schematically illustrating a receiving connector together with a plug connector.
Figure 25H:
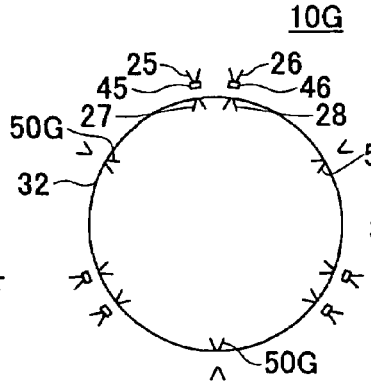

FIGS. 22 and 25H are schematic diagrams of a connector device 10G according to an eighth embodiment of the present invention. The connector device 10G includes the plug connector 30F described above and a receiving connector 20G shown in FIGS. 23A, 23B.

The receiving connector 20G has a slightly different configuration from the receiving connector 20F. That is, ground contact members 50G are additionally provided between the group of contact pieces 23F-1 and the group of contact pieces 23F-2, between the group of contact pieces 23F-2 and the group of contact pieces 23F-3, and between the group of contact pieces 23F-3 and the group of contact pieces 23F-1.

Figure 23A:
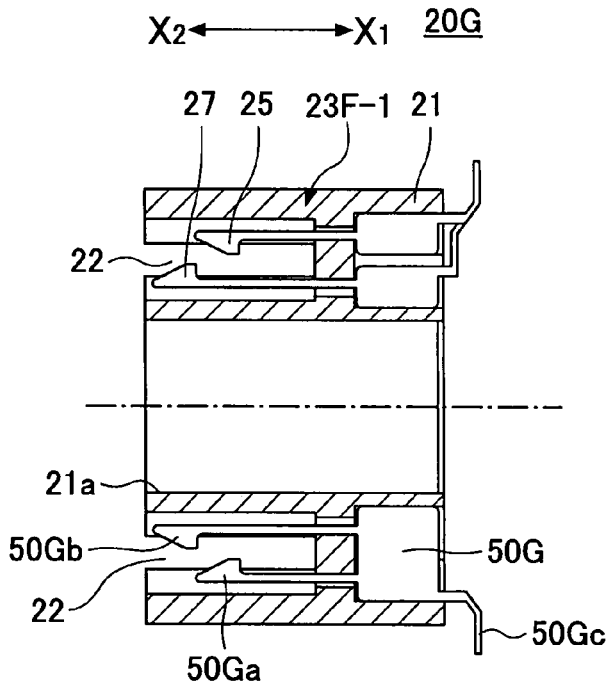
Figure 23B:
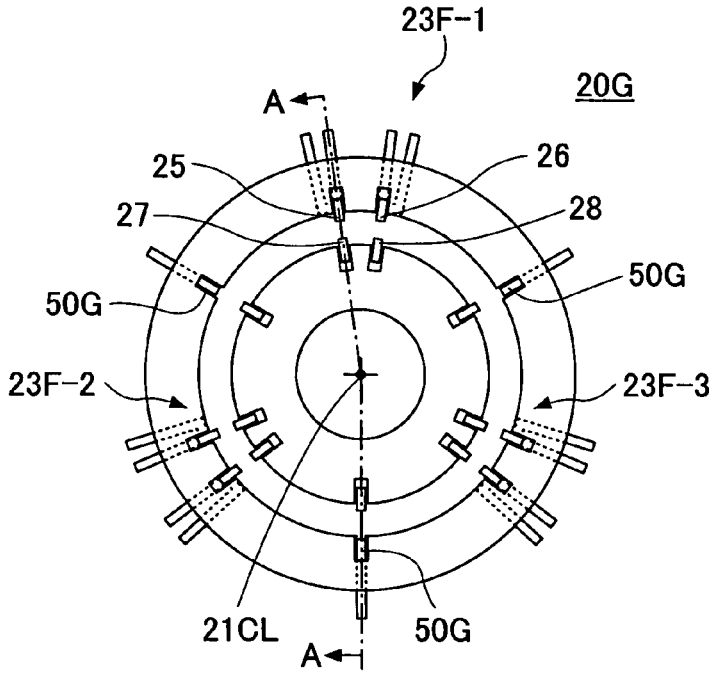

As shown in FIG. 23A, each of the ground contact members 50G includes an outer contact piece 50Ga, an inner contact piece 50Gb, and a leg part 50Gc.

The inner contact piece 50Gb is arranged closer to the inner periphery than the toroidal space 22, and contacts the inserted cylindrical ground pattern 32. The leg part 50Gc is mounted on a pad of a printed-circuit board by soldering. The ground contact member 50G has ground potential.

In a status where the plug connector 30F is connected to the receiving connector 20G, as shown in FIGS. 22 and 25H, the ground contact member 50G is provided in between the pairs of signals adjacent to each other in the circumferential direction, in order to shield the adjacent pairs of signals from each other. Accordingly, in the connector device 10G, interference is even further prevented from occurring between signals adjacent to each other in the circumferential direction, compared to the connector device 10F shown in FIG. 18.

Ninth Embodiment

Figure 24:
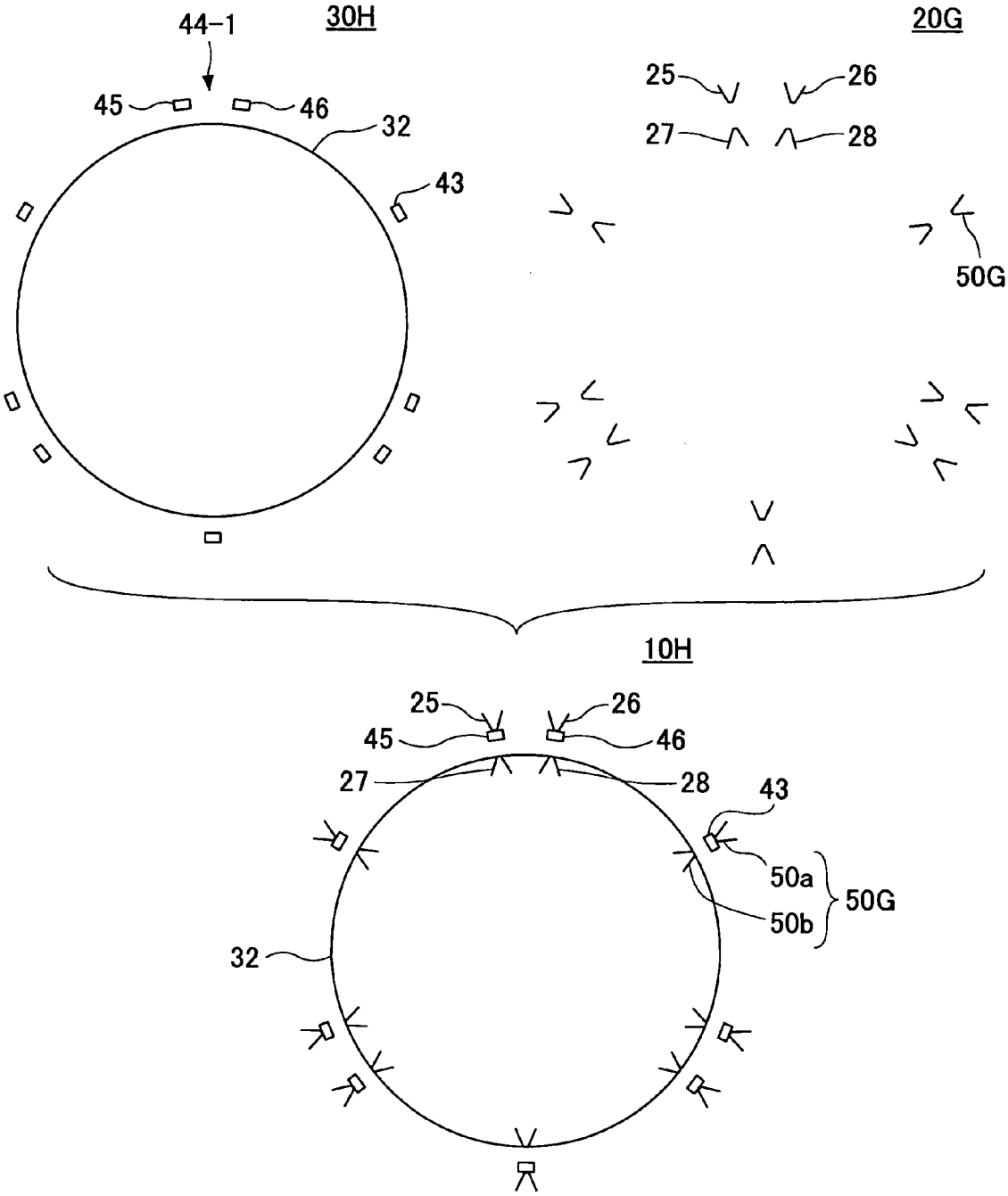
FIG. 24 is a diagram of a connector device according to a ninth embodiment of the present invention, schematically illustrating a receiving connector together with a plug connector.
Figure 25I:
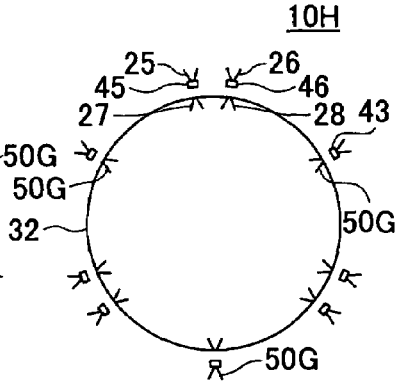

FIGS. 24 and 25I are schematic diagrams of a connector device 10H according to a ninth embodiment of the present invention. The connector device 10H includes a plug connector 30H and the receiving connector 20G shown in FIGS. 23A, 23B.

Figure 10A:
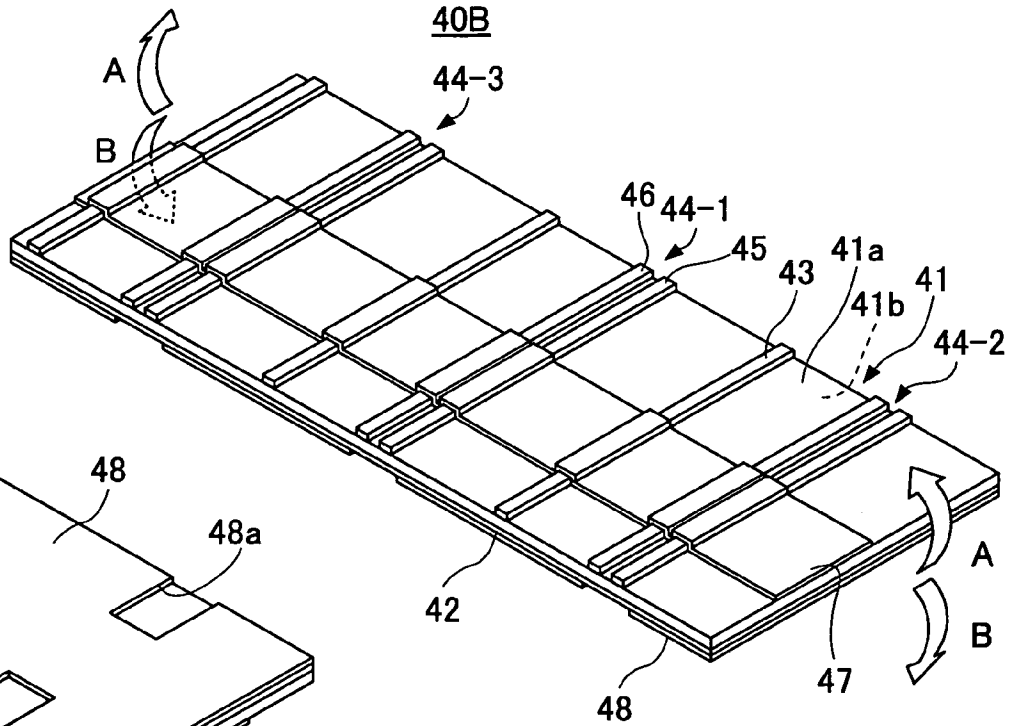
FIGS. 10A, 10B are perspective views of another sheet member.
Figure 10B:
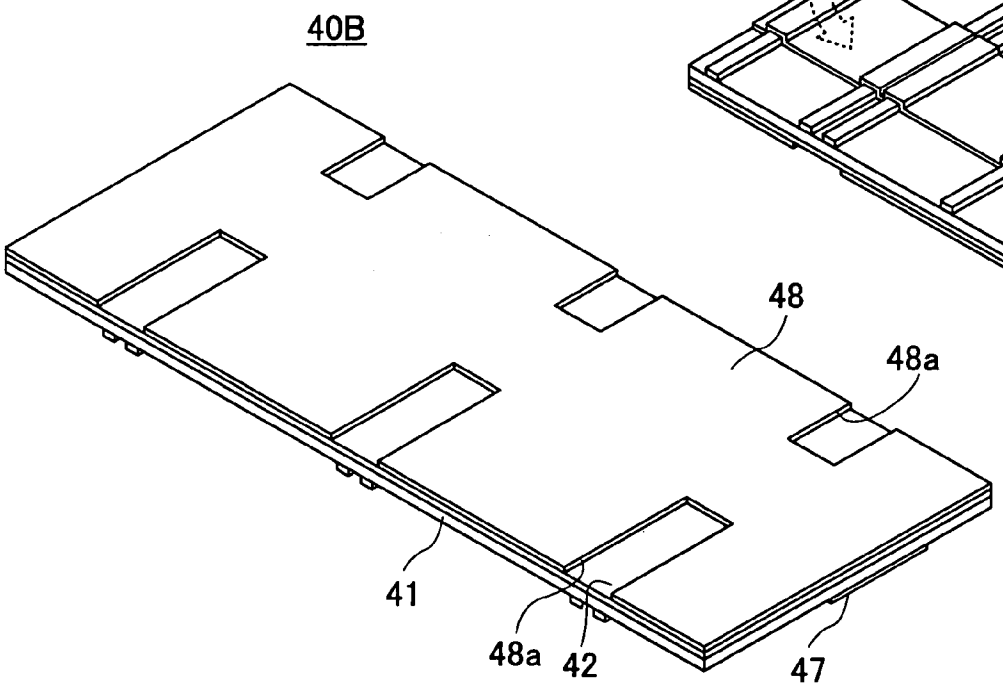

The connector device 10H is manufactured by curving the sheet member 40B shown in FIGS. 10A, 10B in the direction indicated by the arrow B, thus forming a cylindrical shape. On the outer peripherary, the ground contact patterns 43 are provided in between adjacent pairs of signal contact patterns 44-1 through 44-3, extending in parallel with the signal contact patterns.

When the plug connector 30H is connected to the receiving connector 20G, as shown in FIGS. 24 and 25I, the cylindrical ground pattern 32 is in contact with the inner contact piece 50*b* and the ground contact pattern 43 is in contact with the outer contact piece 50*a*.

Furthermore, the pairs of signals adjacent to each other in the circumferential direction are shielded from each other by the ground contact pattern 43, the cylindrical shielding ground member 29, and the ground contact members 50G. Accordingly, in the connector device 10H, interference is even further prevented from occurring between signals adjacent to each other in the circumferential direction, compared to the connector device 10G.

Tenth Embodiment

Figure 26:
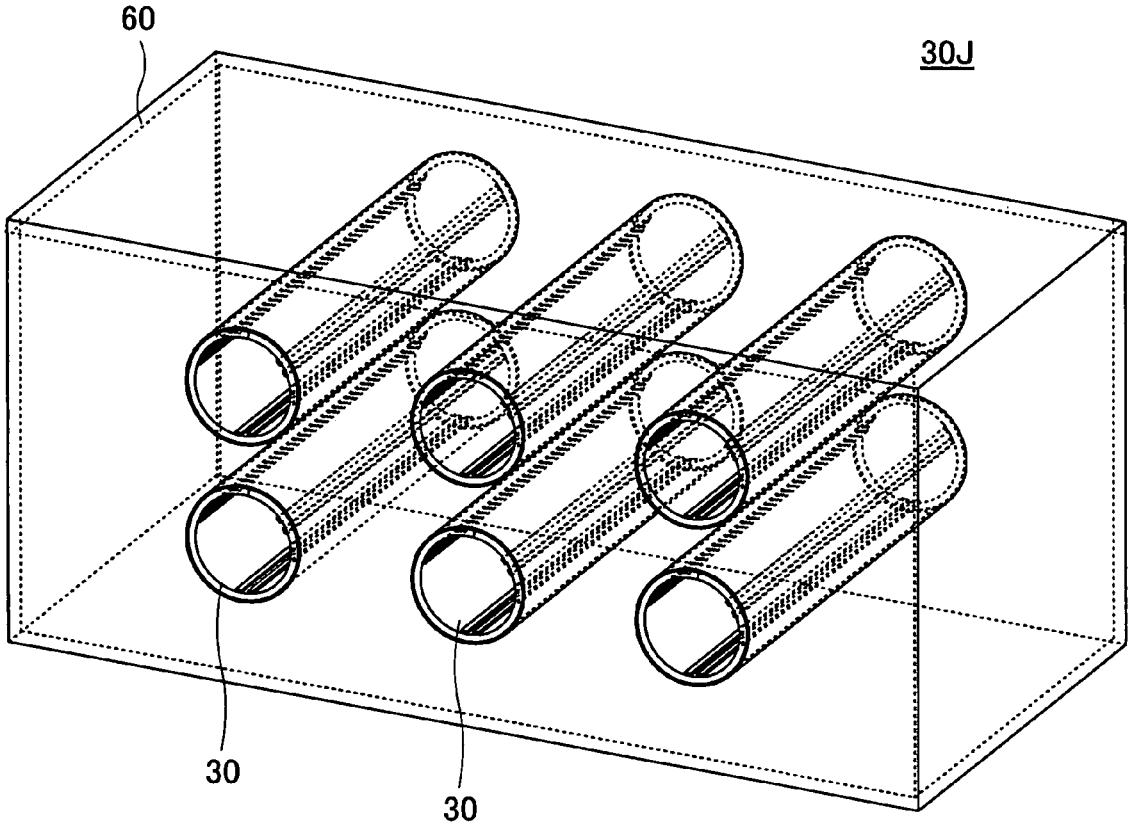
FIG. 26 is a perspective view of a plug connector according to a tenth embodiment of the present invention.

FIG. 26 is a perspective view of a plug connector 30J according to a tenth embodiment of the present invention. In the plug connector 30J, plural plug connectors 30 according to any of the above-described embodiments are provided as a single integral unit in a rectangular parallelepiped insulative block 60.

Eleventh Embodiment

Figure 27:
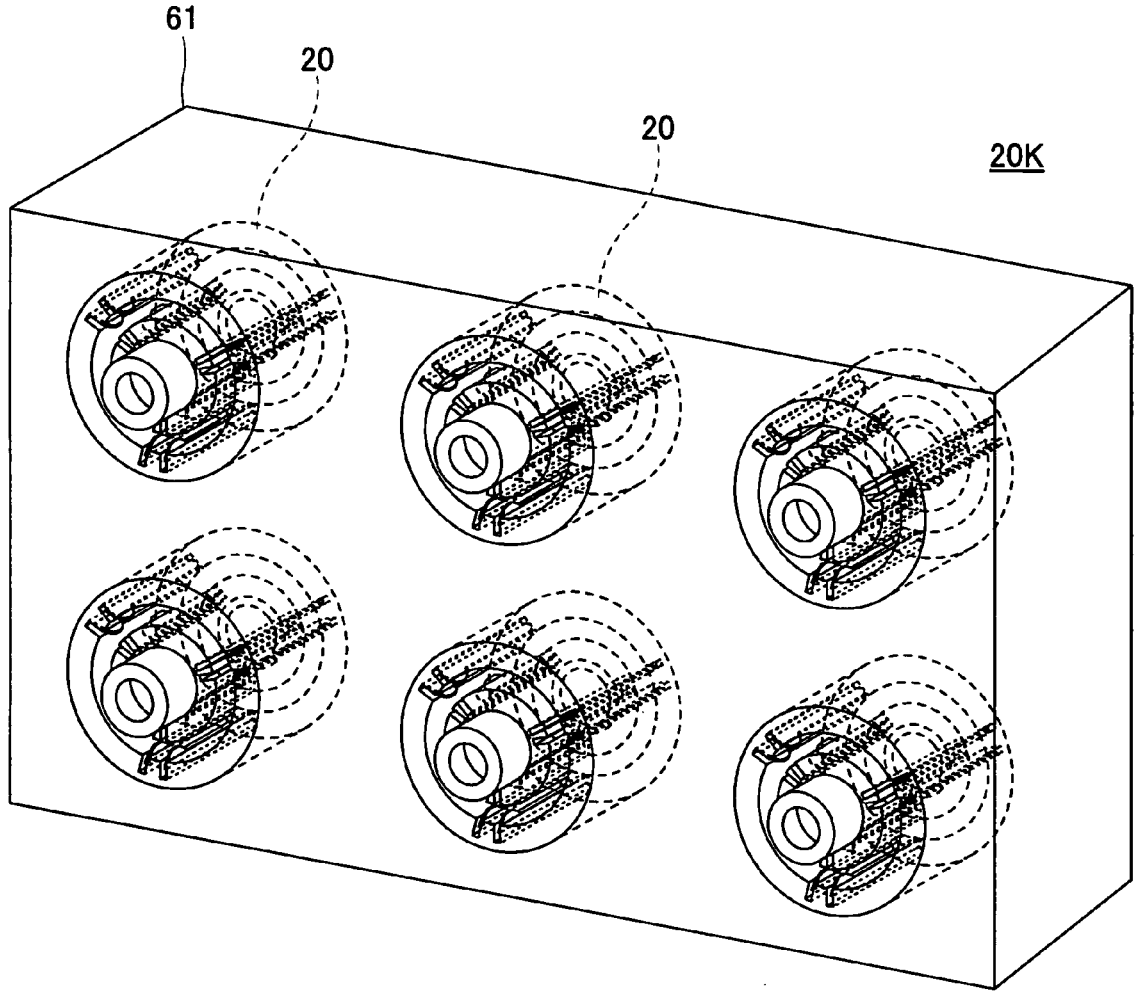
FIG. 27 is a perspective view of a receiving connector according to an eleventh embodiment of the present invention.

FIG. 27 is a perspective view of a receiving connector 20K according to an eleventh embodiment of the present invention. In the receiving connector 20K, plural receiving connectors 20 according to any of the above-described embodiments are provided as a single integral unit in a rectangular parallelepiped insulative block 61.

[Modification]

In the plug connectors 30 and the receiving connectors 20 according to the above-described embodiments, the signal contact patterns and the signal contact pieces need not be provided as pairs in each signal transmission path—they can be provided individually. A connector with such a configuration can be applied to a regular transmission method. This type of connector has the same effects as those of the connector device 10 applied to a balanced transmission method.

The present invention is not limited to the specifically disclosed embodiment, and variations and modifications may be made without departing from the scope of the present invention.

The present application is based on Japanese Priority Patent Application No. 2007-088779, filed on Mar. 29, 2007, the entire contents of which are hereby incorporated by reference.

What is claimed is:

1. A plug connector configured to be plugged into and connected to a receiving connector, the plug connector comprising:

plural signal contact members arranged along a circumferential direction; and a cylindrical ground unit surrounding an outer peripheral side of the signal contact members;

further comprising:

a sheet member with insulative properties, wherein:

a sheet-like pattern acting as the cylindrical ground unit substantially entirely covers one side of the sheet member;

a liner pattern acting as the signal contact members is formed on another side of the sheet member; and the sheet member is rolled in such a manner as to form a cylindrical shape.

2. The plug connector according to claim 1, further comprising:

one or more ground contact members each arranged between adjacent said signal contact members.

3. The plug connector according to claim 1, wherein:

the signal contact members are arranged in pairs in such a manner that balanced transmission can be performed.

4. A plug connector comprising a plurality of the plug connectors according to claim 1 provided in a single integral unit.

5. The plug connector according to claim 2, further comprising:

a sheet member with insulative properties, wherein:

a sheet-like pattern acting as the cylindrical ground unit substantially entirely covers one side of the sheet member;

a linear pattern acting as the signal contact members and the ground contact members is formed on another side of the sheet member; and the sheet member is rolled in such a manner as to form a cylindrical shape.

6. A connector device comprising:

the plug connector according to claim 1; and the receiving connector into which the plug connector is plugged, the receiving connector comprising:

plural ground contact pieces arranged along the circumferential direction in such a manner as to contact the cylindrical ground unit of the plug connector; and plural signal contact pieces arranged along the circumferential direction in such a manner as to contact the signal contact members of the plug connector.

7. A connector device comprising:

the plug connector according to claim 1, further comprising one or more ground contact members each arranged between adjacent said signal contact members, wherein the cylindrical ground unit surrounds the outer peripheral side of the signal contact members and the ground contact members; and the receiving connector into which the plug connector is plugged, the receiving connector comprising:

plural signal contact pieces arranged along the circumferential direction in such a manner as to contact the signal contact members of the plug connector; and plural ground contact pieces arranged along the circumferential direction in such a manner as to contact the cylindrical ground unit and the ground contact members of the plug connector.

8. A plug connector configured to be plugged into and connected to a receiving connector, the plug connector comprising:

plural signal contact members arranged along a circumferential direction; and a cylindrical ground unit arranged on an inner peripheral side of the signal contact members;

further comprising:

a sheet member with insulative properties, wherein:

a sheet-like pattern acting as the cylindrical ground unit substantially entirely covers one side of the sheet member;

a linear pattern acting as the signal contact members is formed on another side of the sheet member; and the sheet member is rolled in such a manner as to form a cylindrical shape.

9. A connector device comprising:

the plug connector according to claim 8; and the receiving connector into which the plug connector is plugged, the receiving connector comprising:

plural ground contact pieces arranged along the circumferential direction in such a manner as to contact the cylindrical ground unit of the plug connector; and plural signal contact pieces arranged along the circumferential direction in such a manner as to contact the signal contact members of the plug connector.

10. A connector device comprising:

the plug connector according to claim 8, further comprising one or more ground contact members each arranged between adjacent said signal contact members, wherein the cylindrical ground unit surrounds the inner peripheral side of the signal contact members and the ground contact members; and the receiving connector into which the plug connector is plugged, the receiving connector comprising:

plural signal contact pieces arranged along the circumferential direction in such a manner as to contact the signal contact members of the plug connector; and plural ground contact pieces arranged along the circumferential direction in such a manner as to contact the cylindrical ground unit and the ground contact members of the plug connector.

11. A receiving connector into which a plug connector is plugged, wherein the plug connector comprises plural signal contact members arranged along a circumferential direction and a cylindrical ground unit surrounding an outer peripheral side of the signal contact members, the receiving connector comprising:

plural ground contact pieces arranged along the circumferential direction in such a manner as to contact the cylindrical ground unit of the plug connector; and plural signal contact pieces arranged along the circumferential direction in such a manner as to contact the signal contact members of the plug connector;

wherein;

the signal contact pieces are arranged in pairs in such a manner that balanced transmission can be performed.

12. The receiving connector according to claim 11, further comprising:

ground contact shielding pieces each arranged in such a manner as to contact the cylindrical ground unit of the plug connector and to shield adjacent said signal contact members from each other.

13. The receiving connector according to claim 11, further comprising:

a cylindrical shield member arranged on a center side.

14. A receiving connector comprising a plurality of the receiving connectors according to claim 11 provided in a single integral unit.

15. A receiving connector into which a plug connector is plugged, wherein the plug connector comprises plural signal contact members arranged along a circumferential direction, one or more ground contact members each arranged between adjacent said signal contact members, and a cylindrical ground unit surrounding an outer peripheral side of the signal contact members and the ground contact members, the receiving connector comprising:

plural signal contact pieces arranged along the circumferential direction in such a manner as to contact the signal contact members of the plug connector; and plural ground contact pieces arranged along the circumferential direction in such a manner as to contact the cylindrical ground unit and the ground contact members of the plug connector.

16. A receiving connector into which a plug connector is plugged, wherein the plug connector comprises plural signal contact members arranged along a circumferential direction and a cylindrical ground unit arranged on an inner peripheral side of the signal contact members, the receiving connector comprising:

plural ground contact pieces arranged along the circumferential direction in such a manner as to contact the cylindrical ground unit of the plug connector; and plural signal contact pieces arranged along the circumferential direction in such a manner as to contact the signal contact members of the plug connector.

17. The receiving connector according to claim 16, further comprising:

ground contact shielding pieces each arranged in such a manner as to contact the cylindrical ground unit of the plug connector and to shield adjacent said signal contact members from each other.

18. A receiving connector into which a plug connector is plugged, wherein the plug connector comprises plural signal contact members arranged along a circumferential direction, one or more ground contact members each arranged between adjacent said signal contact members, and a cylindrical ground unit arranged on an inner peripheral side of the signal contact members and the ground contact members, the receiving connector comprising:

plural signal contact pieces arranged along the circumferential direction in such a manner as to contact the signal contact members of the plug connector; and plural ground contact pieces arranged along the circumferential direction in such a manner as to contact the cylindrical ground unit and the ground contact members of the plug connector.

* * * * *

UNITED STATES PATENT AND TRADEMARK OFFICE

CERTIFICATE OF CORRECTION

PATENT NO. : 7,458,853 B2
APPLICATION NO. : 11/892138
DATED : December 2, 2008
INVENTOR(S) : Kimihiko Omura et al.

It is certified that error appears in the above-identified patent and that said Letters Patent is hereby corrected as shown below:

Column 11, Line 64, change “liner” to --linear--.

Signed and Sealed this

Tenth Day of March, 2009

JOHN DOLL
*Acting Director of the United States Patent and Trademark Office*